US005749027A

United States Patent [19]

Ikemoto et al.

[11] Patent Number: 5,749,027

[45] Date of Patent: May 5, 1998

[54] PROCESS CARTRIDGE, PROCESS CARTRIDGE ASSEMBLY METHOD, AND IMAGE FORMING APPARATUS

[75] Inventors: Isao Ikemoto, Kawasaki; Yoshikazu Sasago, Tokyo; Haruhisa Oshida, Hatogaya; Toshiyuki Karakama, Tokyo; Shinya Noda, Yokohama, all of Japan

[73] Assignee: Canon Kabushiki Kaisha, Tokyo, Japan

[21] Appl. No.: 637,266

[22] Filed: Apr. 25, 1996

[30] Foreign Application Priority Data

Apr. 28, 1995 [JP] Japan ..... 7-105001

[51] Int. Cl.[6] ..... G03G 15/00

[52] U.S. Cl. ..... 399/113; 399/111; 399/125

[58] Field of Search ..... 399/110, 111, 399/113, 114, 125, 119, 116, 117

[56] References Cited

U.S. PATENT DOCUMENTS 5,331,372 7/1994 Tsuda et al. .
5,404,198 4/1995 Noda et al. .
5,470,635 11/1995 Shirai et al. .
5,475,470 12/1995 Sasago et al. .
5,488,459 1/1996 Tsuda et al. .
5,510,878 4/1996 Noda et al. .
5,543,898 8/1996 Shishido et al. .

*Primary Examiner*—Matthew S. Smith
*Attorney, Agent, or Firm*—Fitzpatrick, Cella, Harper & Scinto

[57] ABSTRACT

An assembling method of a process cartridge detachably mountable to a main assembly of an image forming apparatus includes a. preparing a drum frame to which an electrophotographic photosensitive drum is mounted; b. preparing a developing frame having a toner accommodating portion for accommodating toner for developing a latent image formed on the electrophotographic photosensitive drum and also having a developing device mounted thereto, for developing the latent image formed on the electrophotographic photosensitive drum, using toner accommodated in the toner accommodating portion; c. engaging a portion of the drum frame and a portion of the developing frame; d. coupling a coupling member with a portion where the drum frame and the developing frame are engaged to couple the drum frame and developing frame, wherein the drum frame and the developing frame are rotatable relative to each other about the coupling member; e. spring mounting process of mounting a compression spring to apply elastic force to the drum frame and the developing frame thus coupled.

45 Claims, 21 Drawing Sheets

PROCESS CARTRIDGE, PROCESS CARTRIDGE ASSEMBLY METHOD, AND IMAGE FORMING APPARATUS

FIELD OF THE INVENTION AND RELATED ART

The present invention relates to a process cartridge, a method for assembling a process cartridge, and an image forming apparatus.

The image forming apparatus in this specification includes an electro-photographic copying machine, an electro-photographic printer (for example, an LED printer or a laser beam printer), an electro-photographic facsimile, an electro-photographic word processor, and the like.

The process cartridge in this specification is a cartridge which is removably installable in the main assembly of an image forming apparatus, and in which a charging means, a developing means or a cleaning means, and an electro-photographic photosensitive member are integrally housed. It may integrally comprise an electro-photographic photosensitive member, and at least the charging means, the developing means, or the cleaning means, or may integrally comprise an electro-photographic photosensitive member, and at least the developing means. The charging means, the developing means, and the cleaning means are processing means which act on the electro-photographic photosensitive member.

A process cartridge system in which the aforementioned process cartridge is removably installed in the main assembly of an image forming apparatus, has been employed in an image forming apparatus based on the electro-photographic image formation process. According to this process cartridge system, users themselves can maintain the image forming apparatus; there is no need for service personnel. Therefore, this process cartridge system can remarkably improve the operational efficiency of the image forming apparatus. Consequently, the process cartridge system has been widely employed in the field of the image forming apparatus.

The present invention is a result of the further development of the aforementioned process cartridge.

SUMMARY OF THE INVENTION

Accordingly, a primary object of the present invention is to provide a process cartridge which can be assembled with improved efficiency, a method for assembling the process cartridge with improved efficiency, and an image forming apparatus compatible with such a process cartridge.

Another object of the present invention is to provide a process cartridge in which an electro-photographic photosensitive member and a developing means can be reliably disposed, a method for assembling such a process cartridge, and an image forming apparatus compatible with such a process cartridge.

Another object of the present invention is to provide a process cartridge capable of reliably keeping the electro-photographic photosensitive member and the developing means in contact with each other with a predetermined contact pressure, a method for assembling such a process cartridge, and an image forming apparatus compatible with such a process cartridge.

According to an aspect of the present invention, there is provided an assembling method of a process cartridge detachably mountable to a main assembly of an image forming apparatus, comprising the steps of: a. preparing a drum frame to which an electrophotographic photosensitive drum is mounted; b. preparing a developing frame having a toner accommodating portion for accommodating toner for developing a latent image formed on the electrophotographic photosensitive drum and also having developing means, mounted thereto, for developing the latent image formed on the electrophotographic photosensitive drum, using toner accommodated in the toner accommodating portion; c. engaging a portion of the drum frame and a portion of the developing frame; d. coupling a coupling member with a portion where the drum frame and the developing frame are engaged to couple the drum frame and developing frame, wherein the drum frame and the developing frame are rotatable relative to each other about the coupling member; e. spring mounting process of mounting a compression spring to apply elastic force to the drum frame and the developing frame thus coupled.

According to another aspect of the present invention, there is provided a process cartridge detachably mountable to a main assembly of an image forming apparatus, comprising: an electrophotographic photosensitive drum; developing means for developing a latent image formed on the electrophotographic photosensitive drum; a toner accommodating portion for accommodating toner to be used by the developing means for development; a drum frame for supporting the electrophotographic photosensitive drum; a developing frame for supporting the developing means, the developing frame supporting the toner accommodating portion; a coupling member for coupling the drum frame and the developing frame, wherein the drum frame and the developing frame are rotatable relative to each other about the coupling member; a compression spring, mounted after the drum frame and the developing frame are coupled by the coupling member with each other, for applying elastic force between the drum frame and the developing frame.

According to a further aspect of the present invention, there is provided an electrophotographic image forming apparatus for forming an image on a recording material, wherein a process cartridge is detachably mountable to the image forming apparatus, comprising: a. mounting means for detachably mounting a process cartridge; the process cartridge including: an electrophotographic photosensitive drum; developing means for developing a latent image formed on the electrophotographic photosensitive drum; a toner accommodating portion for accommodating toner to be used by the developing means for development; a drum frame for supporting the electrophotographic photosensitive drum; a developing frame for supporting the developing means, the developing frame supporting the toner accommodating portion; a coupling member for coupling the drum frame and the developing frame, wherein the drum frame and the developing frame are rotatable relative to each other about the coupling member; a compression spring, mounted after the drum frame and the developing frame are coupled by the coupling member with each other, for applying elastic force between the drum frame and the developing frame; the apparatus further comprising: b. feeding means for feeding the recording material.

According to a further aspect of the present invention, there is provided a compression spring mounting member usable with a process cartridge detachably mountable to a main assembly of an image forming apparatus, wherein the process cartridge comprises an electrophotographic photosensitive drum; developing means for developing a latent image formed on the electrophotographic photosensitive drum; a toner accommodating portion for accommodating toner to be used by the developing means for development; a drum frame for supporting the electrophotographic photosensitive drum; a developing frame for supporting the developing means, the developing frame supporting the toner accommodating portion; a coupling member for coupling the drum frame and the developing frame, wherein the drum frame and the developing frame are rotatable relative to each other about the coupling member, and wherein the compression spring is mounted after the drum frame and the developing frame are coupled by the coupling member with each other, and applies elastic force between the drum frame and the developing frame, the compression spring mounting member, comprising: a base provided with a rib; a compression spring mounting portion provided in the base; a flange provided at a side of the base, wherein the flange is to be mounted to a frame of the process cartridge; wherein the compression spring mounting member is mounted to the process cartridge while the compression spring is mounted to the compression spring mounting portion.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described in detail with reference to the drawings.

First, referring to FIGS. 1–14, a process cartridge in accordance with the present invention, and an electro-photographic image forming apparatus usable with such a process cartridge will be described in detail. As for the order in which descriptions are given, the general structures of the process cartridge and the image forming apparatus employing the process cartridge will be described at first, and then, cartridge installing means, the structure for opening or closing a drum shutter, the opening or closing movement of the drum shutter, and the structure of cartridge frames will follow. Thereafter, a method for joining the aforementioned two cartridge frames will be described.

General Structure

Figure 4:
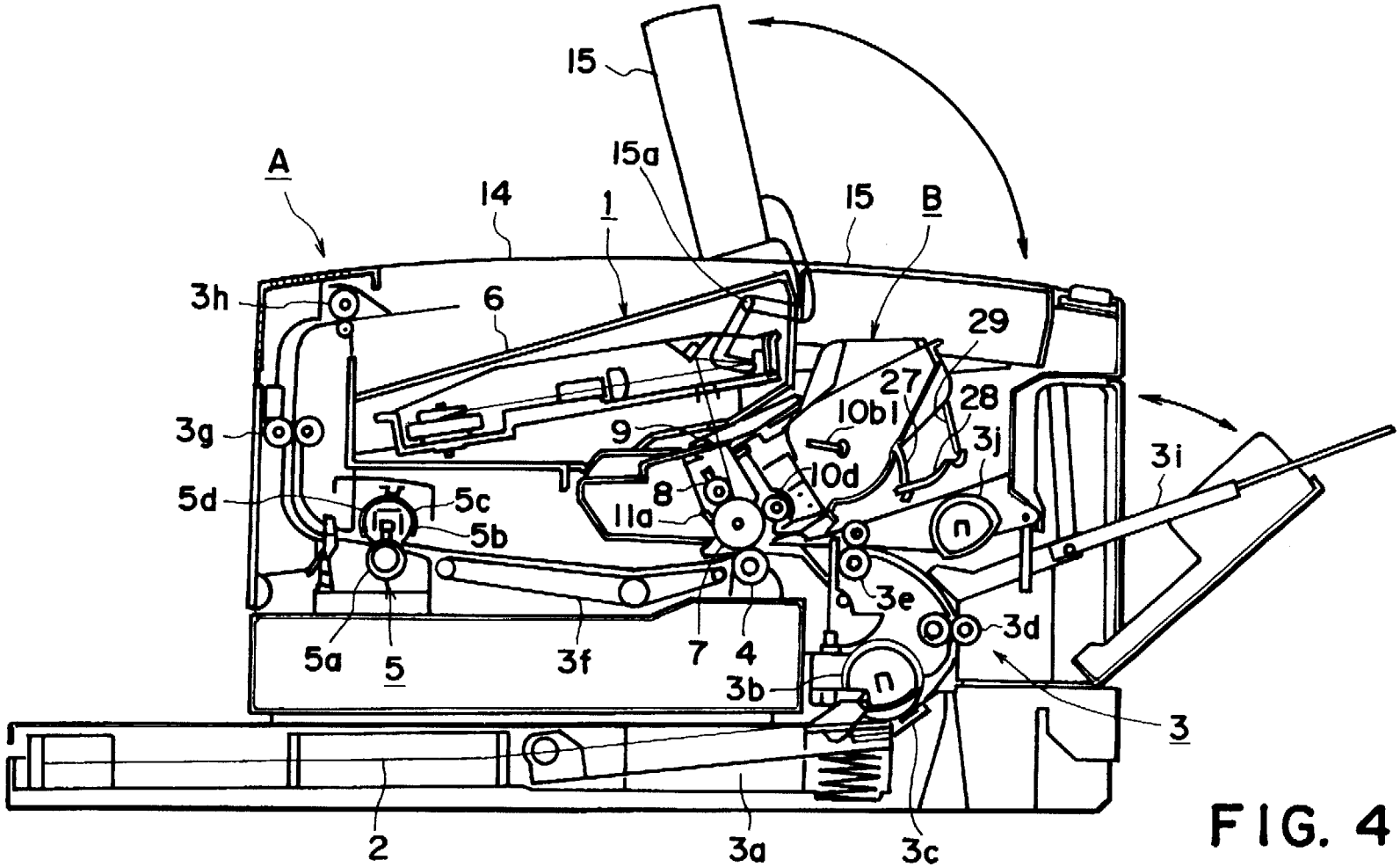
FIG. 4 is a schematic section of an electro-photographic image forming apparatus, depicting the general structure thereof.

Referring to FIG. 4, in the electro-photographic image forming apparatus A (laser beam printer) in accordance with the present invention, a light beam which carries image data is projected from an optical system 1 onto an electro-photographic photosensitive member in the form of a drum to form a latent image thereon, and this latent image is developed into a toner image. The electro-photographic photosensitive member is charged by a charge roller 8 before it is irradiated with the image data carrying light beam. In synchronism with the formation of the toner image, recording mediums 2 disposed in a sheet feeder cassette **3*a* are separated and fed into the electro-photographic image forming apparatus one by one by a pickup roller 3*b* and a pressing member 3*c* placed in contact with the pickup roller 3*b* to apply a predetermined pressure. The recording medium 2 is further conveyed into the apparatus by a conveying means 3 comprising a conveyer roller pair 3*d*, a registration roller pair 3*e*, and the like. As a voltage is applied to a transfer roller 4 as a transferring means, the toner image formed on the electro-photographic photosensitive member integrally disposed in a process cartridge B is transferred onto the recording medium 2. The recording medium 2 having received the toner image is delivered to a fixing means 5 by a conveyer belt 3*f*. The fixing means 5 comprises a driving roller 5*a*, and a fixing roller 5*d*. The fixing roller 5*d* contains a heater 5*b* and is rotatively supported by a supporting member 5*c*. While the recording medium 2 is passed through the fixing means 5, heat and pressure are applied to the recording medium 2, whereby the toner image having been transferred onto the recording medium is fixed to the recording medium 2. The recording medium 2 with the fixed toner image is conveyed through a reversing passage and discharged into a sheet catcher portion 6, by discharge roller pairs 3*g* and 3*h*. This image forming apparatus A also comprises a manual feeder tray 3*i* and a roller pair 3*j* so that the recording medium 2** can be manually fed.

Figure 5:
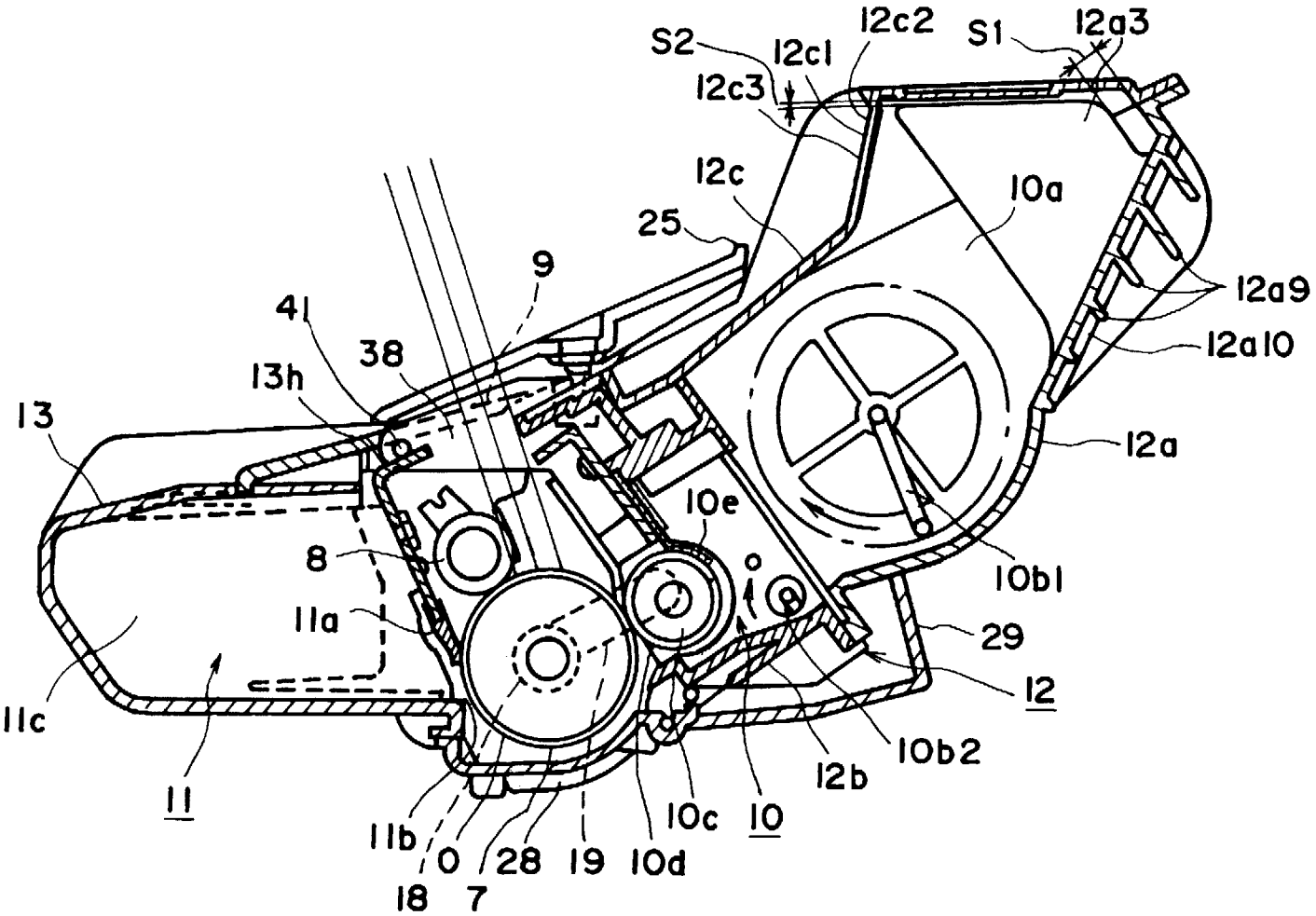
FIG. 5 is a cross-section of a process cartridge.

The process cartridge B in accordance with the present invention comprises an electro-photographic photosensitive member and a minimum of one processing means. The processing means includes a charging means for charging the electro-photographic photosensitive member, a developing means for developing the latent image formed on the electro-photographic photosensitive member, a cleaning means for cleaning the toner remaining the surface of the electro-photographic photosensitive member, and the like. Referring to FIG. 5, in the process cartridge B, a photosensitive drum 7, which is a drum-shaped electro-photographic photosensitive member with a photosensitive layer, is rotated, and the surface of the rotating photosensitive drum 7 is uniformly charged by applying a voltage to the charge roller 8 which is the charging means. The surface of the photosensitive drum 7 is exposed to an optical image projected from the aforementioned optical system 1 through an opening 9, whereby a latent image is formed on the photosensitive drum 7. The latent image is developed by a developing means 10. As is evident from FIG. 5, the charge roller 8 is in contact with the photosensitive drum 7.

In the developing means 10, the toner contained in a toner holding portion 10*a* is sent out by a first rotary toner feeding member 10*b*1 and a second rotary toner feeding member 10*b*2, onto a development roller 10*d*, which is a developing member containing a fixed magnet 10*c*. As the development roller 10*d* is rotated, a layer of toner triboelectrically charged by the development blade 10*e* is formed on the surface of the development roller 10*d*. The toner particles in the toner layer are transferred onto the photosensitive drum 7 in correspondence to the aforementioned latent image, whereby the latent image is developed into a toner image, that is, a visible image.

After the toner image is transferred onto the recording medium 2 by applying to the transfer roller 4 a voltage with a polarity opposite to that of the toner image, the toner remaining on the photosensitive drum 7 is removed by a cleaning means 11 comprising a cleaning blade 11*a* for scraping off the residual toner, a reception sheet 11*b* for receiving the toner scraped from the photosensitive drum 7, and a waste toner collector 11*c* for collecting the waste toner. As is evident from FIG. 5, the cleaning blade 11*a* is in contact with the photosensitive drum 7.

The components such as the photosensitive drum 7 are integrally disposed within the frame of the process cartridge B, so that they can be removably installed within the apparatus main assembly 14. The cartridge frame is formed by joining a development frame 12 and a cleaning frame 13. The development frame 12 is formed by welding together a development frame 12*a*, a development frame bottom portion 12*b*, and a development frame lid 12*c*.

Cartridge Installating Means

Figure 7:
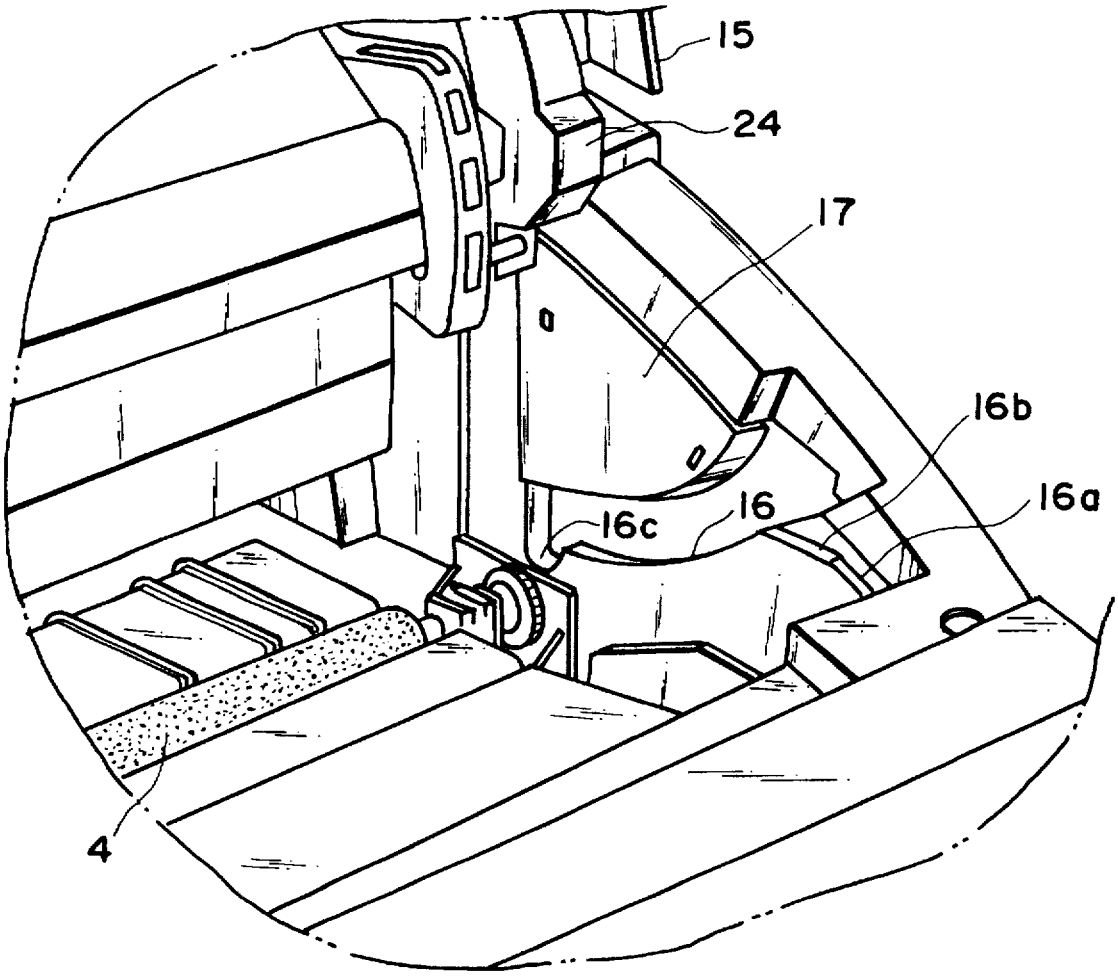
FIG. 7 is an explanatory drawing depicting the structure of the right-hand guide for guiding the process cartridge during the insertion or removal thereof.
Figure 8:
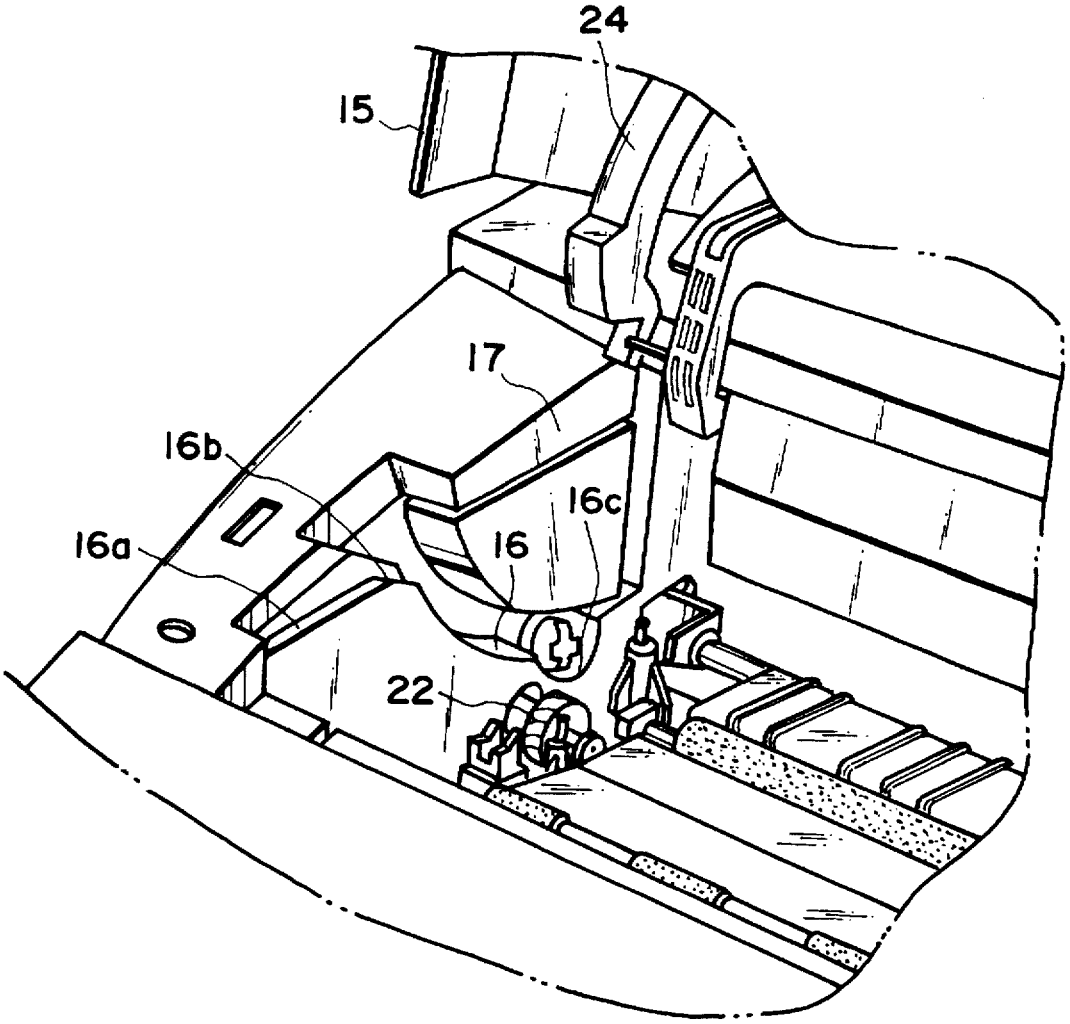
FIG. 8 is an explanatory drawing depicting the structure of the left-hand guide for guiding the process cartridge during the insertion or removal thereof.

The process cartridge B is installed in the apparatus main assembly 14 by opening the lid 15 as shown in the drawing. Referring to FIGS. 7 and 8, the cartridge installating means comprises a pair of guide rails 16, which are exposed as the lid 15 is rotatively opened about an axis 15*a* (FIG. 4). The guide rails 16 are given an upward bowing curvature (in this embodiment, substantially arc-shaped), and symmetrically located in the respective lateral walls of the apparatus main assembly 4 across the cartridge accommodating space. Above the guide rail 16, a guide member 17 is attached. On the entrance side of the guide rail 16, a first slant surface 16*a*, and a second slant surface 16*b* are provided. The second slant surface 16*b* has a steeper angle than the first slant surface 16*a*, and extends further downward from the bottom end of the first slanted surface 16*a*.

Figure 6:
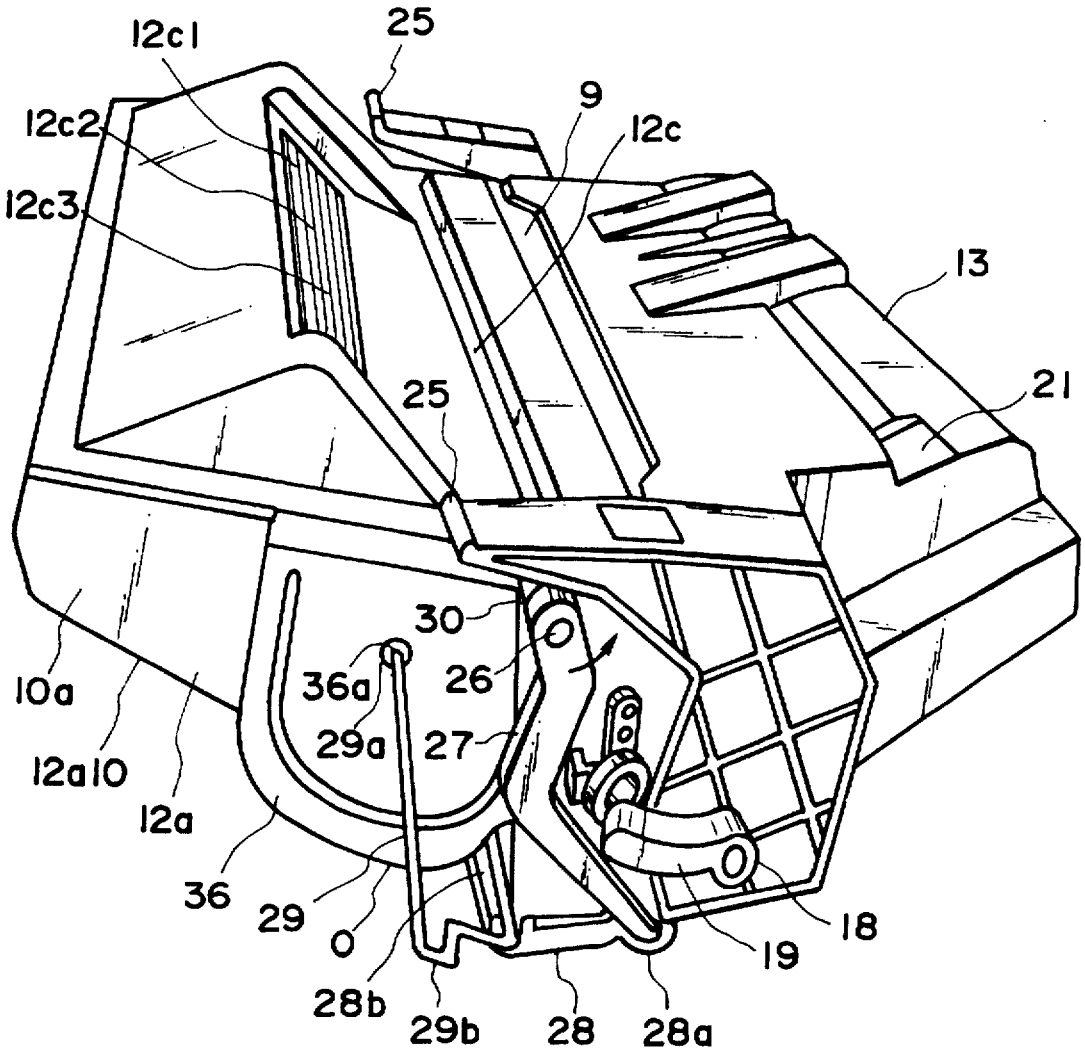
FIG. 6 is an external perspective view of the process cartridge.

On the other hand, the surfaces of the left and right longitudinal ends of the process cartridge B are provided with a guide portion, wherein the two guide portions symmetrically project in the longitudinal direction from the correspondent end surfaces of the process cartridge B, and are guided by the guide rail 16. Referring to FIG. 6, the guide portion integrally comprises a boss portion 18 and a rib portion 19. The boss portion 18 and the rib portion 16 are integrally formed with the cleaning frame 13 to which the photosensitive drum 7 is attached. The boss portion 18 is in line with the imaginary extension of the rotational axis of the photosensitive drum 7, and the rib portion 19 extends backward, relative to the inserting direction of the process cartridge B, from the boss portion 18, forming a upward bowing curvature (in this embodiment, substantially arc-shaped), which matches the configuration of the guide rail 16.

Referring to FIGS. 10–15, when the process cartridge B is installed into the apparatus main assembly with the above described structure, the lid 15 is first opened, and the process cartridge B is inserted into the apparatus main assembly so that the leading end of the process cartridge B is caused to dive into the space below the optical means 1. The guide rail 16 is arc-shaped, and the guide member 17 disposed above the guide rail 16 is given a configuration matching that of the guide member 17. Further, the rib 19 also is given a configuration similar to that of the guide member 17. Consequently, as the process cartridge B is inserted deeper, its orientation becomes substantially horizontal. As the cartridge B is pushed further inward, a bumping member 20 provided on the apparatus main assembly 14 comes in contact with a contact surface 21 provided on each longitudinal end of the leading end portion of the cleaning frame 13, and then, the boss portion 18 of the process cartridge drops into a recess 16*c* located at the deepest end of the guide rail 16. As a result, a drum gear (unillustrated) fixed to one of the longitudinal ends of the photosensitive drum 7 is caused to engage with the driving gear 22 (FIG. 8) provided on the apparatus main assembly 14 side, enabling the driving force to be transmitted to the process cartridge B.

Figure 12:
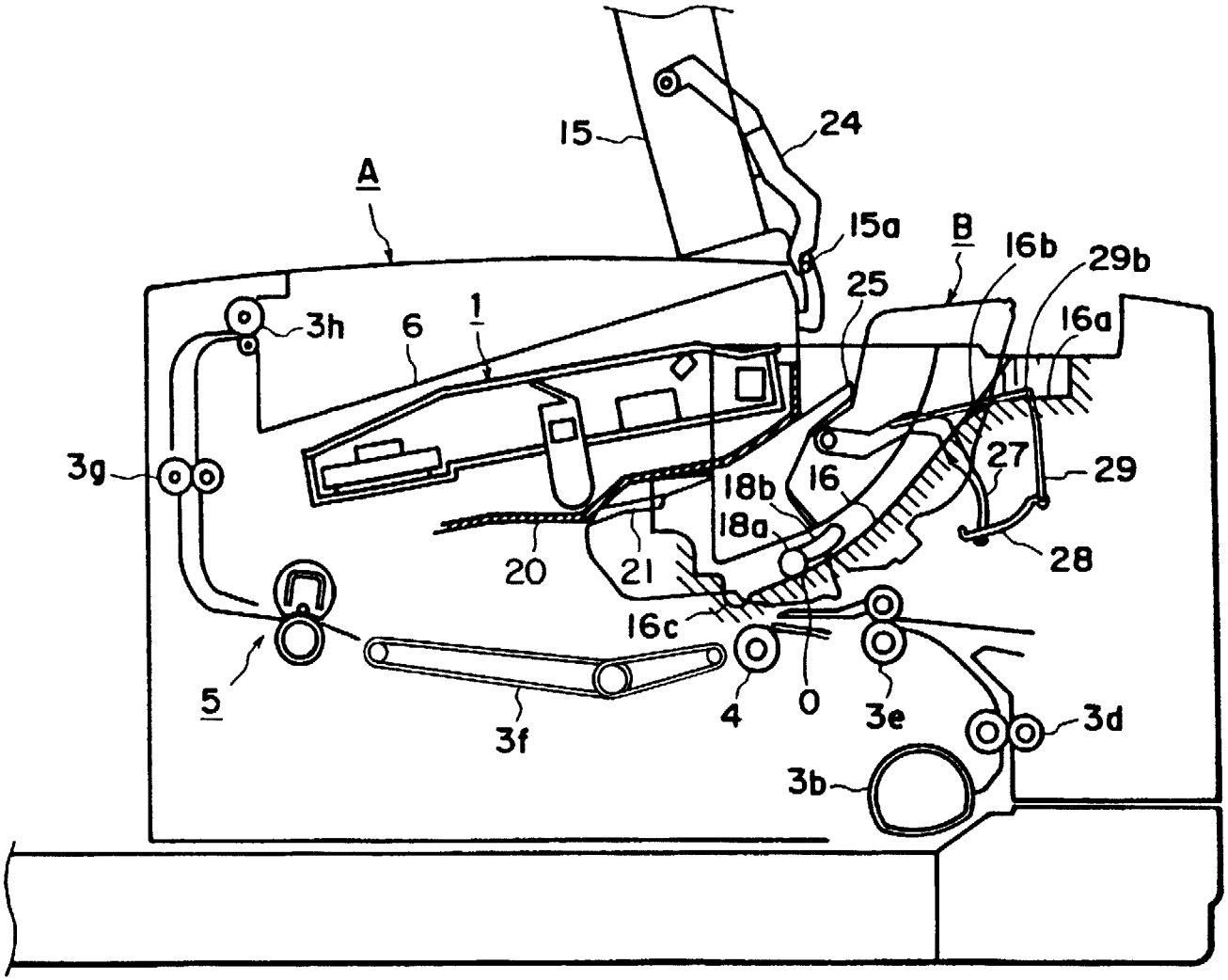
FIG. 12 is a sectional view depicting the state of the process cartridge having been further inserted into the image forming apparatus.

Next, referring to FIG. 12, as the lid 15 is closed, a pressing member 24, which is axially supported on the lid 15, and is under the pressure from a torsional coil spring, makes contact with the arm portion 38 of the cleaning frame 13, pressing it with a predetermined pressure generated from the torsional coil spring being torqued by the closing movement of the lid 15. At the same time, the bumping member 20 provided on the apparatus main assembly 14 makes contact with the contact surface 21 of the process cartridge B, fixing the position of the process cartridge B.

Figure 15:
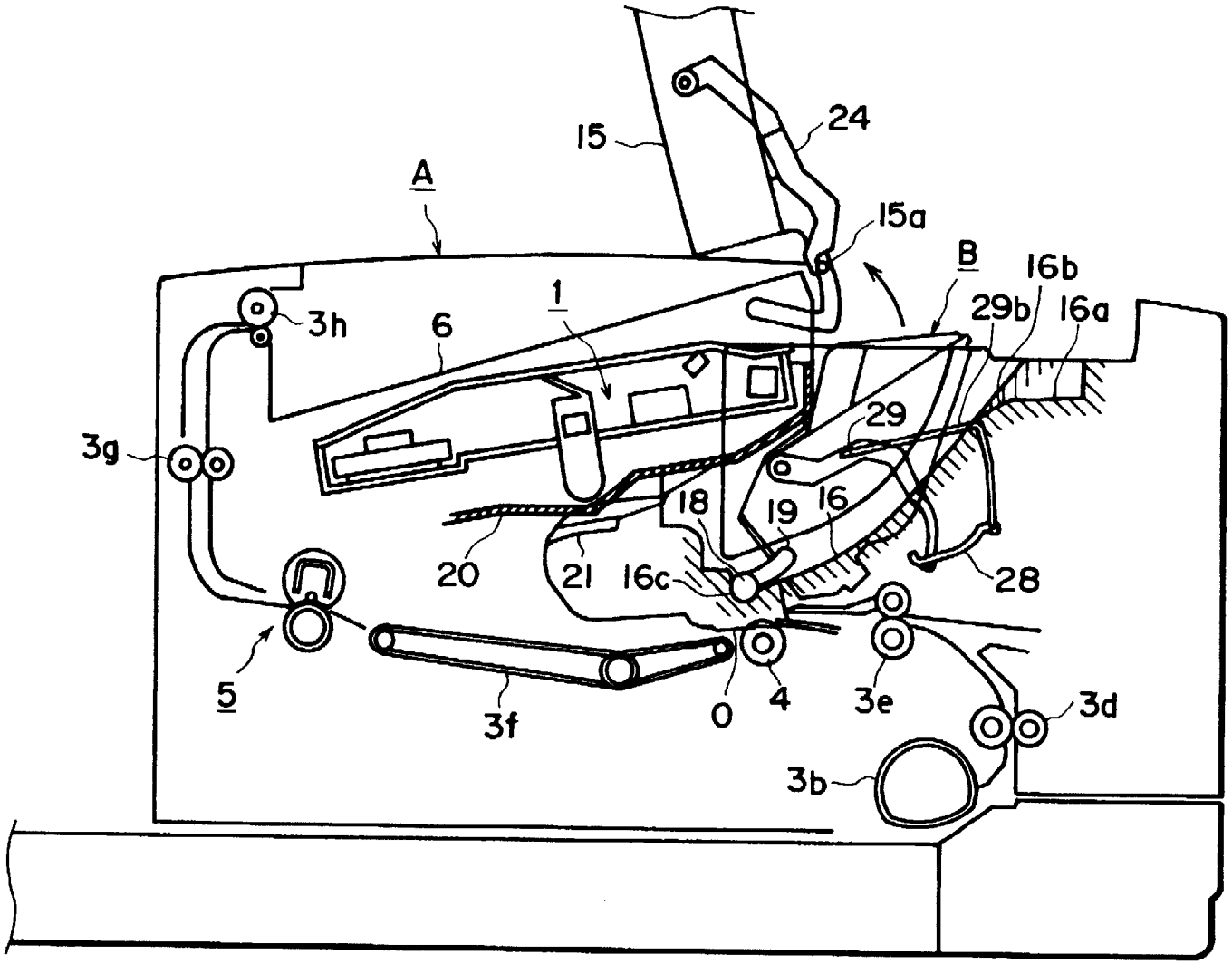
FIG. 15 is a sectional drawing depicting the image forming apparatus, the lid of which is open, and in which the process cartridge has been completely installed.

Referring to FIG. 15, in order to take out the process cartridge B, the users open the lid 15, whereby the pressure applied through the pressing member 24 is removed. In this state, the cartridge B is pulled upward so that the boss portion 18 comes out of the recess 16*c*. Thereafter, the process cartridge B can be removed by pulling it as if rotating it in the the counterclockwise direction of FIG. 12, with the rib portion 19 following the guide rail 16.

Figure 11:
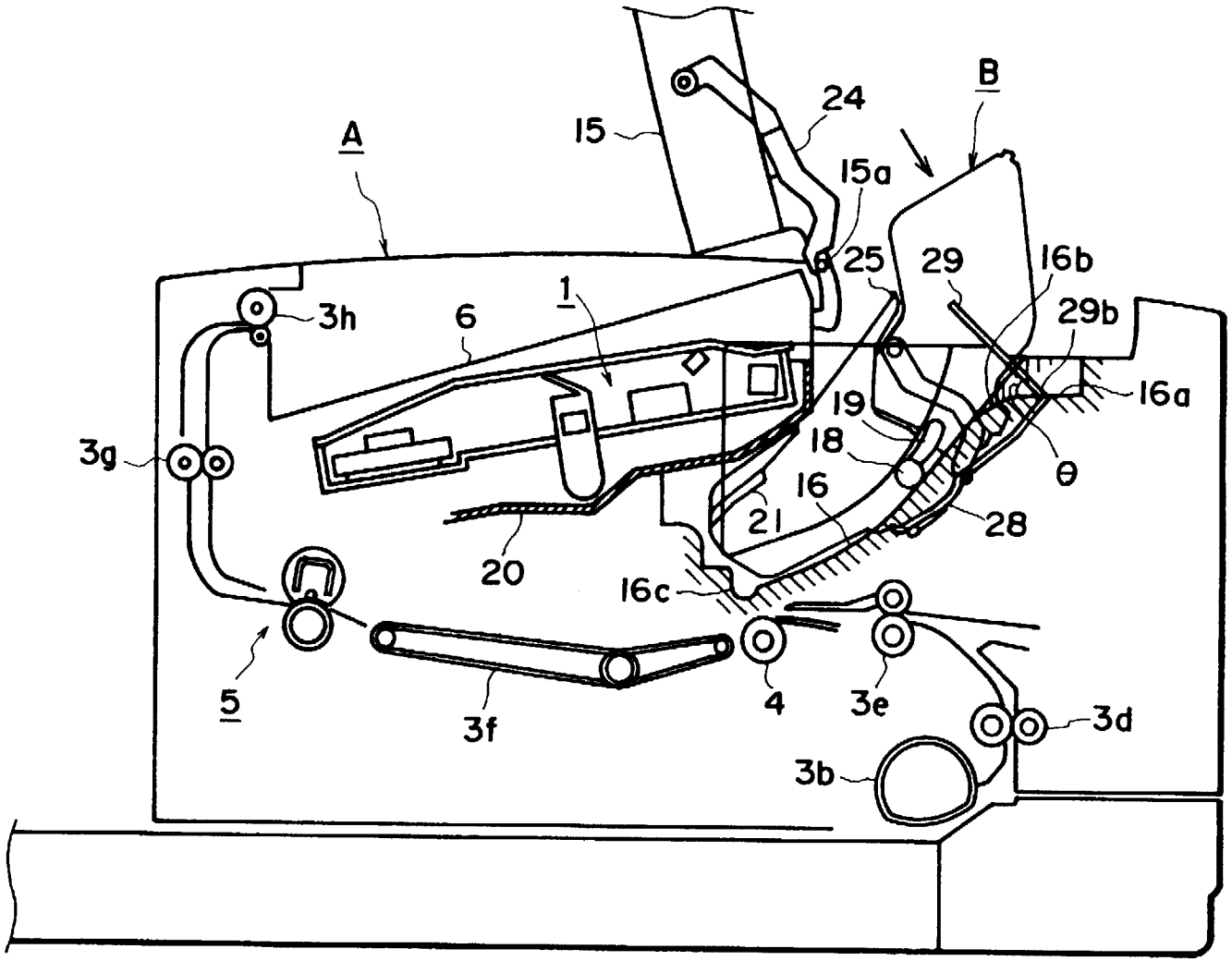
FIG. 11 is a sectional drawing depicting the state of the process cartridge having been further inserted into the image forming apparatus.

The bottom portion of the cartridge frame is provided with an opening O, through which the photosensitive drum 7 comes in contact with the conveyed recording medium 2. When the cartridge is not in use, the opening is covered by closing a drum shutter member 28 to protect the photosensitive drum 7. Referring to FIG. 6, the drum shutter member 28 is rotatively supported by a shutter arm 27 and a link member 29. The shutter arm 27 is rotatively mounted on an axis 26 projecting outward from the longitudinal lateral wall of the development frame 12, but the link member 29 is supported on the longitudinal lateral wall of the cartridge frame so that it can be rotated about the rotational center 29*a*. As the process cartridge B is inserted along the guide rail 16 as described above, a projecting portion 29*b* constituted of the bend portion of the link member 29 comes in contact with the first and second slant surfaces 16*a* and 16*b* of the guide rail 16, causing the shutter member 28 to open (FIGS. 11 and 12). On the contrary, as the process cartridge B is taken out, the shutter member 28 is automatically closed by the pressure from the torsional coil spring 30 (FIG. 6) fitted around the axis 26.

Figure 20:
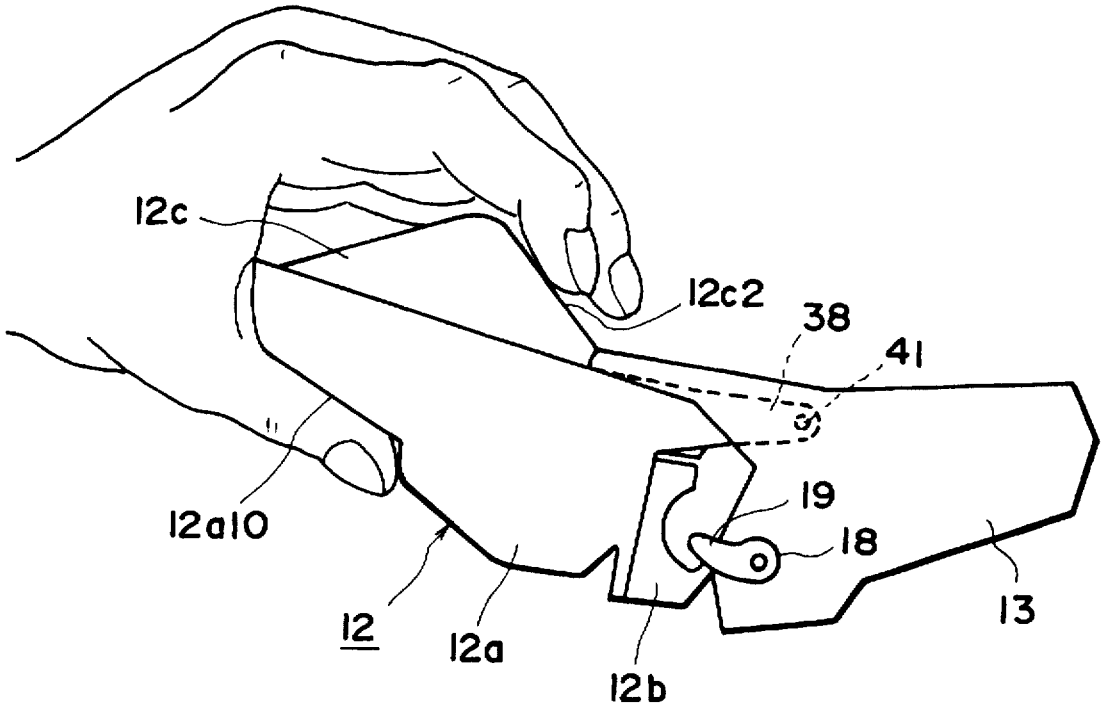
FIG. 20 is a perspective drawing depicting how the process cartridge is held by a hand.

When the process cartridge B is inserted into or removed from the image forming apparatus A, the users pick up process cartridge B by the handhold portion 12*c*2 of the development frame 12. The handhold portion 12*c*2 comprises the slanted upward facing surface of the cartridge lid 12*c*. Referring to FIG. 6, this slanted portion, that is, the handhold portion 12*c*2, is provided with minute ridges and valleys formed by numerous ribs 12*c*1 (extending in the direction perpendicular to the direction in which the process cartridge B is inserted into, or removed from, the apparatus main assembly). Referring to FIG. 5, the bottom portion of the cartridge frame is provided with an R portion which bulges downward, and this R portion is provided with several ribs 12*a*9 extending in the same direction as the aforementioned ribs 12*a*1, constituting the handhold portion 12*a*10. In order to install the process cartridge B into the image forming apparatus A, or remove it therefrom, the users pick up the process cartridge B by grasping it by the handhold portions 12*c*2 and 12*a*10 (ribs 12*c*1 and ribs 12*a*9) as illustrated in FIG. 20, and then insert it into the apparatus main assembly, with the boss portion 18 and the rib portion 19 of the cleaning frame 13 following the guide rail 16.

When the process cartridge B is pushed into the apparatus main assembly excessively fast, the process cartridge B is liable to be subjected to a large shock, which mostly acts on the pin 41 joining the development frame 12 and the cleaning frame 13. However, the development frame 12 and the cleaning frame 13 are rotatable about the pin 41; therefore, the aforementioned shock is distributed throughout the entire cartridge frame; the shock does not concentrated on a specific portion. In other word, the shock does not concentrate on the welded joint between the toner holding frame portion 12*a* and the development frame bottom portion 12*b*. Therefore, the strength with which the toner holding frame portion 12*a* and the development frame bottom portion 12*b* are welded has only to be enough to keep the both frame portions 12*a* and 12*b* joined. Consequently, when welding the toner holding frame portion 12*a* and the development frame bottom portion 12*b*, it is unnecessary to specifically control the welding conditions, allowing the development frame 12 to be assembled without losing productivity.

Further, the means for positioning the development roller 10*d*, and a mounting seat for the development blade 10*e*, are provided on the toner holding frame portion 12*a* as described in the foregoing. Therefore, in spite of the fact that the toner holding frame portion 12*a* is provided with the arm portion 38, the development roller 10*d* and the development blade 10*e* can be precisely positioned, so that their positional relationship with the photosensitive drum 7 mounted on the cleaning frame 13 can be maintained with sufficient precision.

Structure for Opening or Closing Drum Shutter

Figure 18:
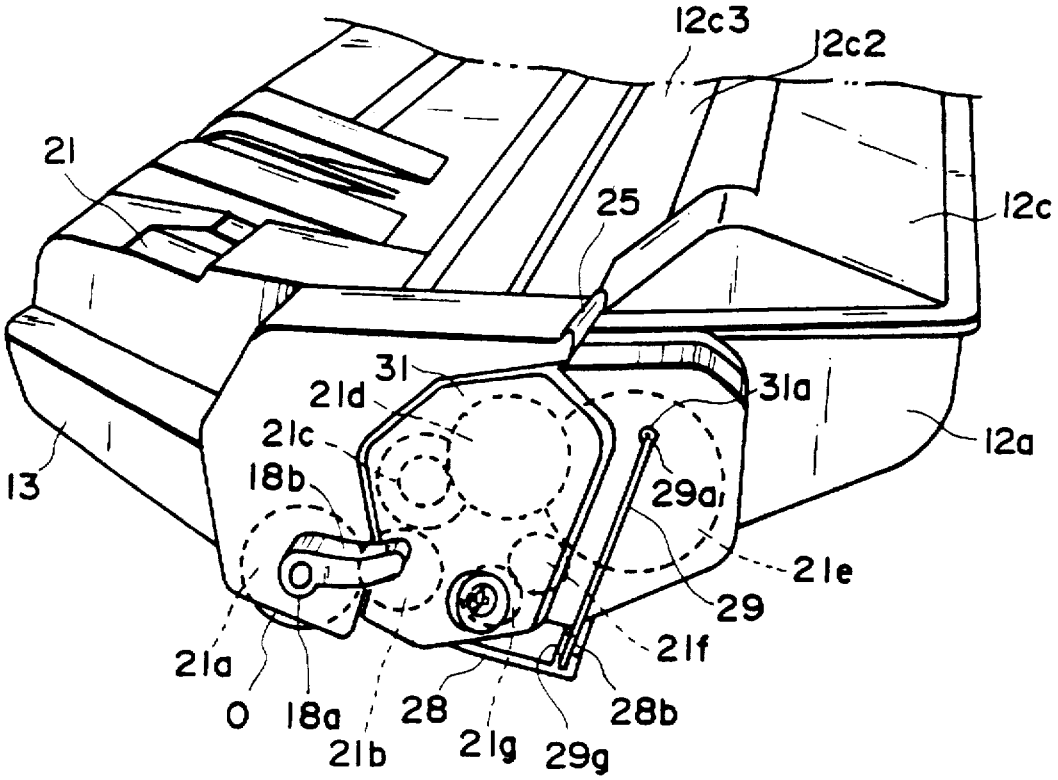
FIG. 18 is an external perspective view of the process cartridge.
Figure 19:
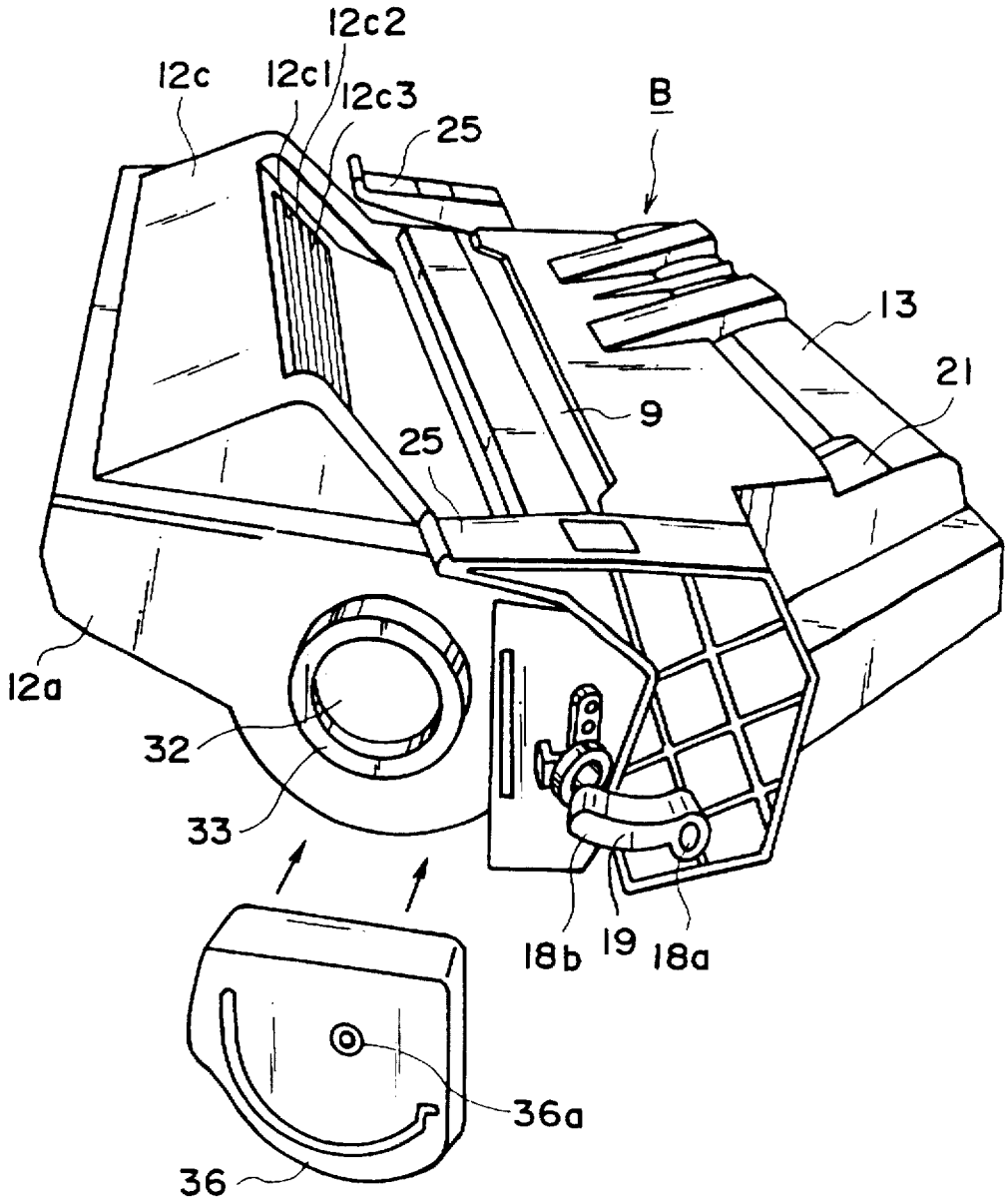
FIG. 19 is a perspective view of the process cartridge, depicting how a linking member is attached thereto.

Referring to FIGS. 6, 18 and 19, the structure for opening or closing the aforementioned drum shutter will be described.

Structure for Opening or Closing

Referring to FIG. 6, one end of the shutter arm 27 is rotatively mounted on the axis 26 provided on the longitudinal end surface of the toner holding frame portion 12*a*, and to the other end, a ring portion 28*a* formed at one end of the shorter edge of the drum shutter member (protective cover) 28 is rotatively attached. The shutter member 28 is provided with a groove 28*b*, which runs adjacent to the longitudinal edge on the side opposite to the ring portion 28*a*, across the entire length of the edge. In this groove 28*b*, the shutter link member (supporting member) 29 formed by bending the metallic wire is rotatively anchored.

Referring to FIGS. 6 and 18, the end portion 29*a* of the link member 29 is rotatively supported by a link supporting member 36 and a gear cover 31. Referring to FIG. 19, the link supporting member 36 covers a toner filling opening 32 of the toner holding frame portion 12*a*. During the assembly process of the process cartridge B, toner is filled into the toner holding portion 10*a* through the toner filling opening 32, and the toner filling opening 32 is sealing with a cap 33. Thereafter, the link supporting member 36 is welded to the toner holding frame portion 12*a*, covering cap 33.

The link supporting member (link mount) 36 is provided with an axis hole 36*a*, which is located at a specific spot (after the welding of the link supporting member 36 to the toner holding frame portion 12*a*, it is located directly above the toner filling opening 32). The end portion 29*a* of the link member 29 is inserted into this axis hole 36*a*, whereby the link member 29 is rotatively supported at the end portion 29*a*.

Referring to FIG. 18, on the other side of the process cartridge B, a gear train comprising a drum gear 21*a* fixed to the longitudinal end of the photosensitive drum 7, and gears 21*b*–21*g*, are mounted on the longitudinal end surface of the toner holding frame portion 12*a*. This gear train transmits a driving force to the development roller 10*d* and the toner sending members 10*b*1 and 10*b*2. The aforementioned gear cover 31 is attached to cover this gear train. The other end 29*a* of the link member 29 is inserted into an axis hole 31*a* provided in the gear cover 31 to rotatively support the link member 29 at the other end 29*a*.

When seen from the direction indicated by an arrow mark in FIG. 6, the link member 29 forms an L-shape, and from its bend portion, a U-shaped projection 29*b* projects outward in the longitudinal direction of the process cartridge B. As this projection 29*b* is rotatively moved, the link member 29 is rotatively moved, whereby the shutter member 28 is caused to expose or cover the opening O.

The aforementioned axis 26 is provided with a torsional coil spring 30, one end of the spring 30 being anchored to the shutter arm 27 and the other end being anchored to the cleaning frame 13; therefore, the shutter member 28 remains under the constant pressure in the closing direction generated by the elasticity of the spring 30.

Opening and Closing Movement

Next, referring to FIGS. 10–15, the opening and closing movements of the drum shutter 28 will be described. First, referring to FIG. 11, as the process cartridge B is inserted into the image forming apparatus A as described before, the projection 29*b* of the link member 29 comes in contact with the first slanted surface 16*a* of the guide rail 16. At this moment of the contact, the angle θ formed by the first slanted surface 16*a* and the link member 29 is an acute angle. As a result, the link member 29 and the first slanted surface 16*a* do not prop against each other, allowing the shutter member 28 to be smoothly opened, and also allowing the smooth insertion of the process cartridge B.

Figure 13:
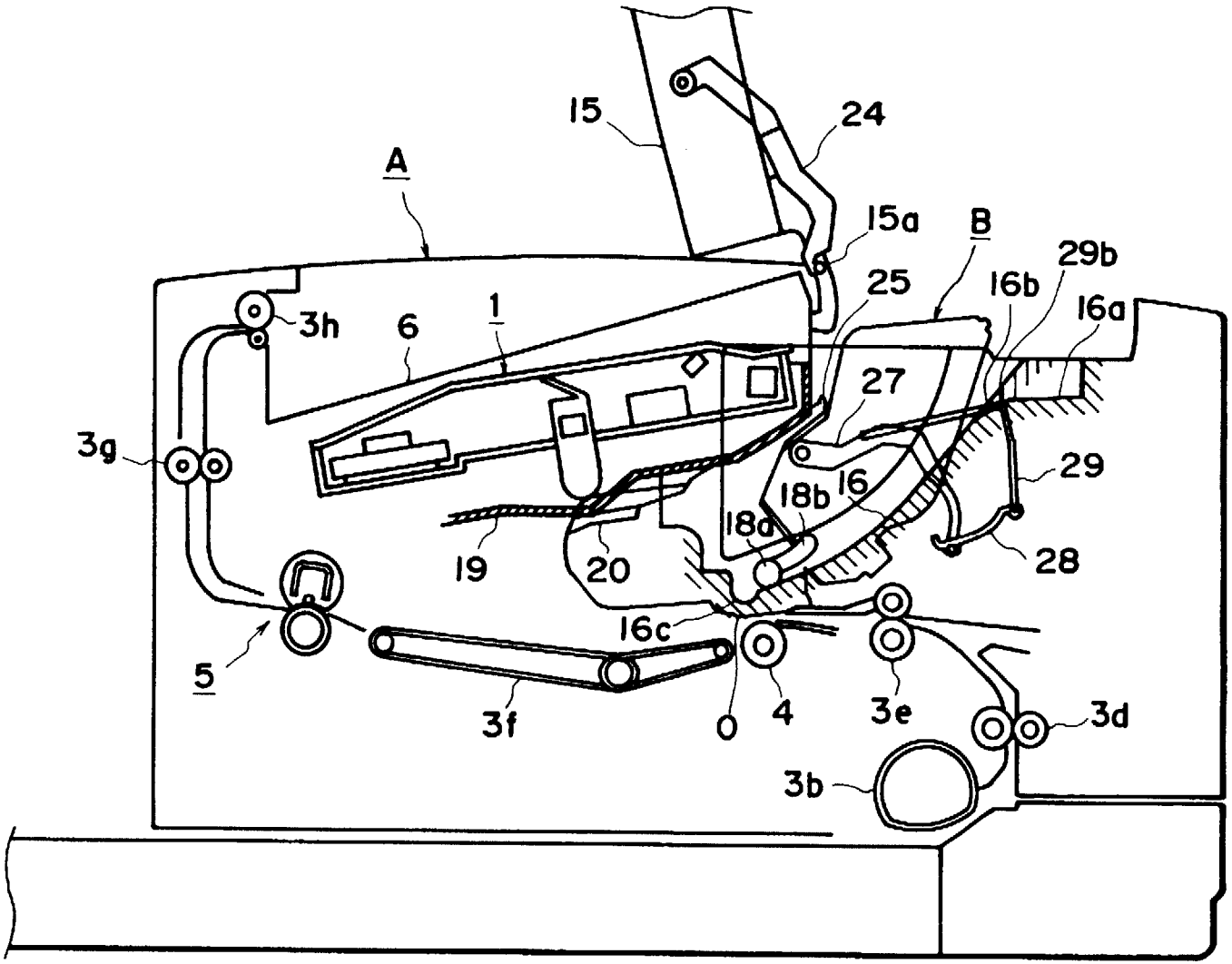
FIG. 13 is a sectional view depicting the state of the process cartridge having been further inserted into the image forming apparatus.
Figure 14:
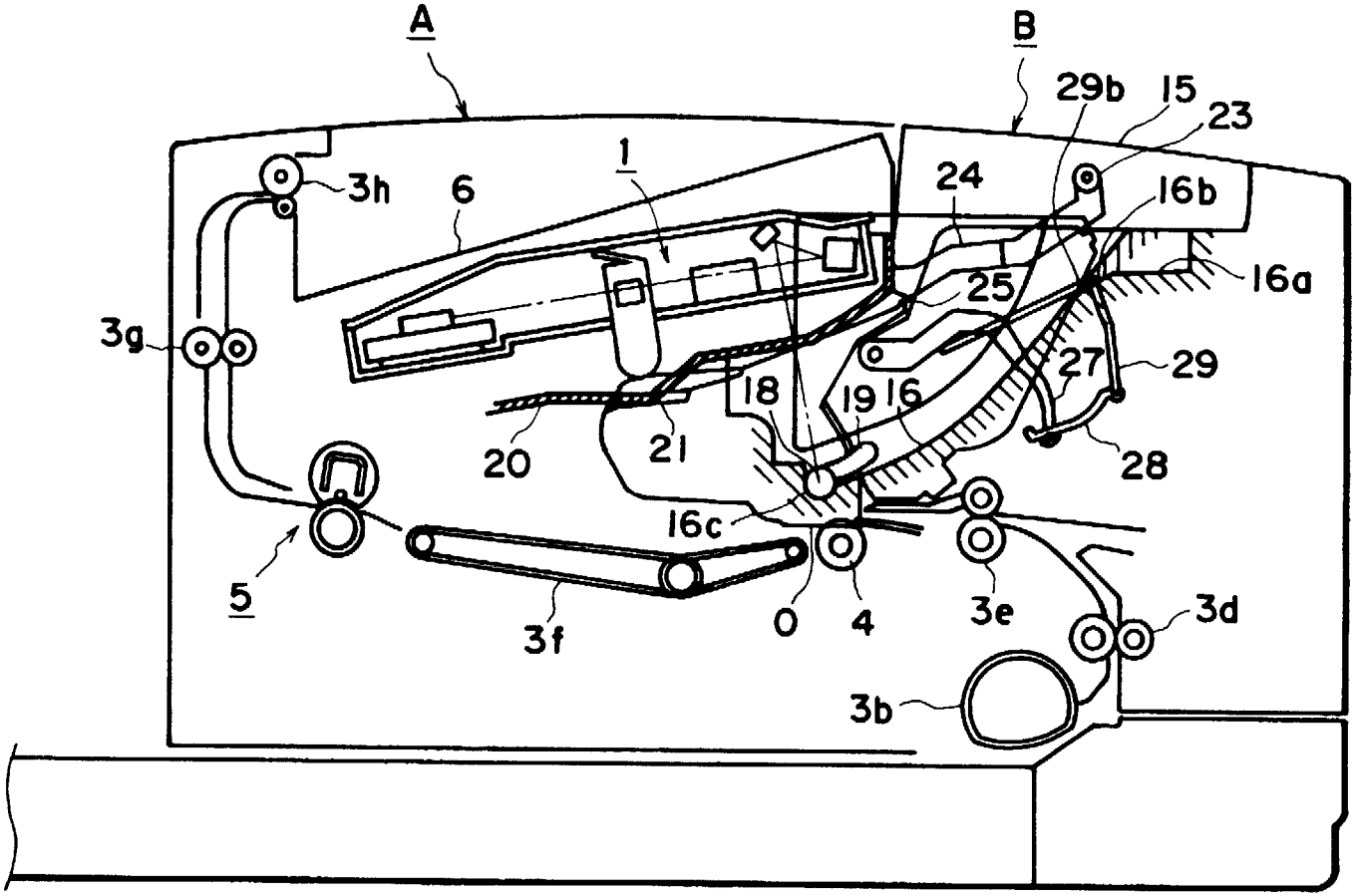
FIG. 14 is a sectional view depicting the state of the process cartridge having been completely installed into the image forming apparatus.

Next, referring to FIG. 12, as the process cartridge B is further inserted, the shutter member 28 is gradually opened backward because the projection 29b remains in contact with the first slanted surface 16a. As the process cartridge B is inserted deeper, the projection 29b moves onto the second slanted surface 16a of the guide rail 16, ending the process cartridge B insertion process, as shown in FIGS. 13 and 14. This second slanted surface 16b is given a steeper angle than the first slanted surface 16a, allowing the shutter member 28 to remain open in the same open state even after the projection 29b of the link member 29 moves onto the second slanted surface 16b due to the further insertion of the process cartridge B; therefore, the shutter member 28 does not open too far, nor does it fail to open sufficiently.

As described above, the shutter member 28 opens or closes as the link member 29 is rotatively moved. But, because the link member 29 is supported by the link supporting member 36 which covers the toner filling opening 32, the rotational center of the link member 29 can be positioned right above the toner filling opening. Therefore, more latitude can be afforded for the positioning of the rotational center of the link member 29, which otherwise is more restricted since the shutter member 28 must follow a predetermined locus within the limited internal space of the image forming apparatus A; even when the size of the toner filling opening 32 must be designed to be large to increase the toner filling efficiency, more latitude can be afforded in determining the location of the mounting point for the link member 29.

Structure of Cartridge Frame

Figure 16:
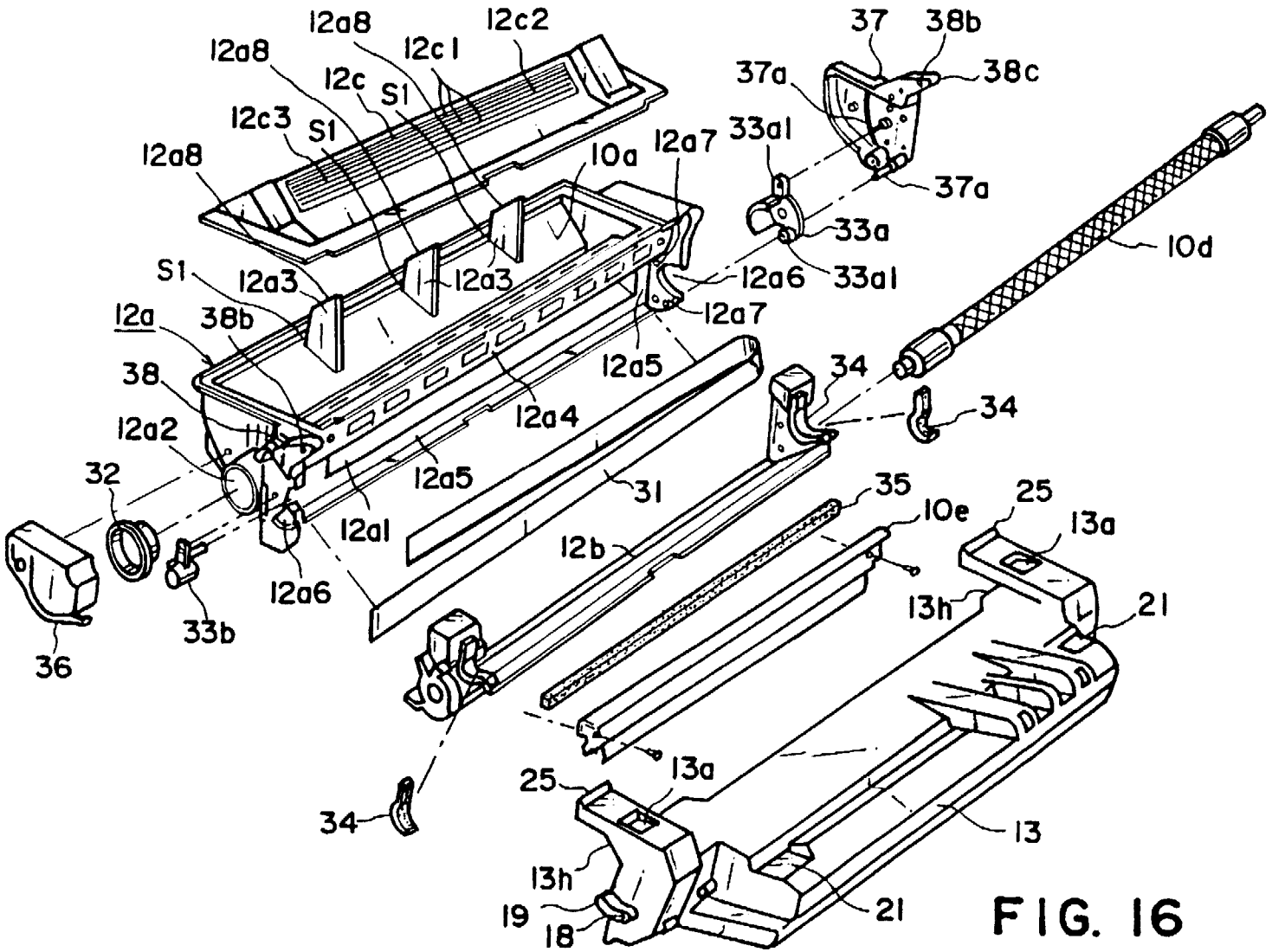
FIG. 16 is an exploded perspective view of the cartridge frame.

Next, the structure of the cartridge frame will be described. The cartridge frame is formed of polystyrol resin using injection molding. Referring to FIG. 16, the cartridge frame is formed by joining a first frame, which is the development frame 12, and a second frame, which is the cleaning frame 13 (drum frame). The development frame 12 is formed by welding the development frame bottom portion 12b (development roller supporting frame) to the toner holding frame portion 12a along their longitudinal edges, and then, welding the lid 12c to the top portion of the preceding two frame portions.

The toner holding frame portion 12a is provided with the toner supply opening 12a1 and the toner filling opening 12a2. The toner supply opening 12a extends in the longitudinal direction, and the toner filling opening 12a2 is located in one of the longitudinal end walls. Within the toner holding frame portion 12a, a number of supporting member 12a3 are provided. They stand upright, and are aligned in the longitudinal direction of the frame portion.

Figure 17:
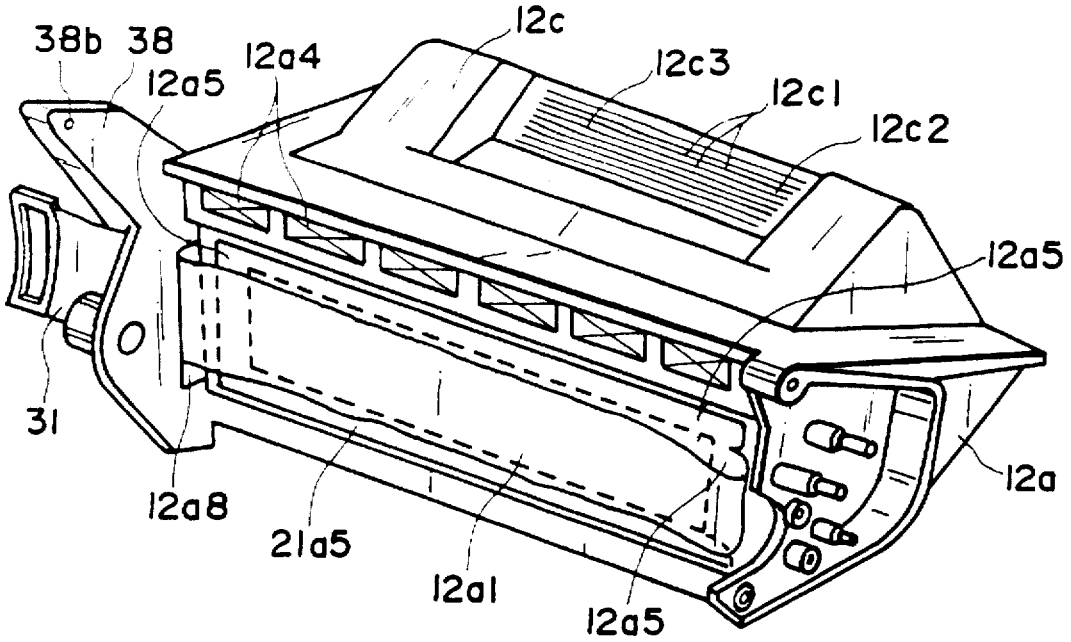
FIG. 17 is a perspective view depicting how the toner seal is attached to the development frame.

When the developing means is assembled, the first toner sending member 10b1 is first assembled into the toner holding frame portion 12a, and then, the lid member 12 is welded. Next, the toner supply opening 12a1 is sealed by welding a toner seal member (film) 31 to the seal attachment seat 12a5 formed around the toner supply opening 12a1. Then, after toner is filled into the toner holding portion 10a of the toner holding frame portion 12a, the cap 32 is placed over the toner filling opening 12a2 to seal the toner holding portion 10a. Referring to FIG. 17, the toner sealing member 31 having sealed the toner supply opening 12a1 is folded back at one of the longitudinal ends of the toner supply opening 12a1, and its free end is caused to be exposed through a slit 12a8 of the toner holding frame portion 12a, so that the users can remove the toner sealing member 31 by pulling the exposed free end when the process cartridge B is initially put to use.

Next, the development frame bottom portion 12b is welded to the toner holding frame portion 12a along the longitudinal edges, and the second toner sending member 10b2 is attached to the development frame bottom portion 12b. Then, a seal 35 formed of foamed urethane, or the like is attached below a blade mounting seat 12a4, and the development blade 10e is screwed to the blade mounting seat 12a4. Next, bearings 33a and 33b, a seal 34 formed of foamed urethane or the like, are attached, and the axis of the development roller 10d is placed in the bearings 33a and 33b. The toner holding frame portion 12a is provided with an arc-shaped portion 12a6, which is a positioning means for fixing the bearings 33a and 33b; the bearings 33a and 33b are fixed to the arc-shaped portion 12a6 of the toner holding frame portion 12a. Therefore, the development roller 10d, the axis of which is supported by the bearings 33a and 33b, is attached to the toner holding frame portion 12a with a preferable degree of precision.

The link support member 36 is attached at one of the longitudinal ends of the development frame 12, covering the aforementioned cap 32. On the other side of the development frame 12, the gear train for transmitting the driving force to the photosensitive drum 7, the development roller 10d, and the like are mounted, and the gear cover 37 is attached to cover the gear train. The gear cover 37 is provided with a positioning axis 37a; the gear cover 37 is fixed to the toner holding frame portion 12a using engagement claws, screws, or the like after its position is fixed by inserting this positioning axis 37a into the hole 33a1 of the bearing 33a, and the hole 12a7 of the toner holding frame portion 12a.

One of the longitudinal ends of the toner holding frame portion 12a is provided with an arm portion 38 as a joint portion, which is integrally formed with the toner holding frame portion 12a. Also, the gear cover 37 attached to the other longitudinal end of the toner holding frame portion 12a is provided with the arm portion 38 as the joint portion (FIG. 16).

The development frame 12, into which various components constituting the aforementioned developing means have been assembled, and the cleaning frame 13, into which the photosensitive drum 7, the charge roller 8, and various components constituting the cleaning means, have been assembled, are joined together at the arm portions 38, completing the process cartridge B.

Structure for Joining Development Frame and Cleaning Frame

Figure 1:
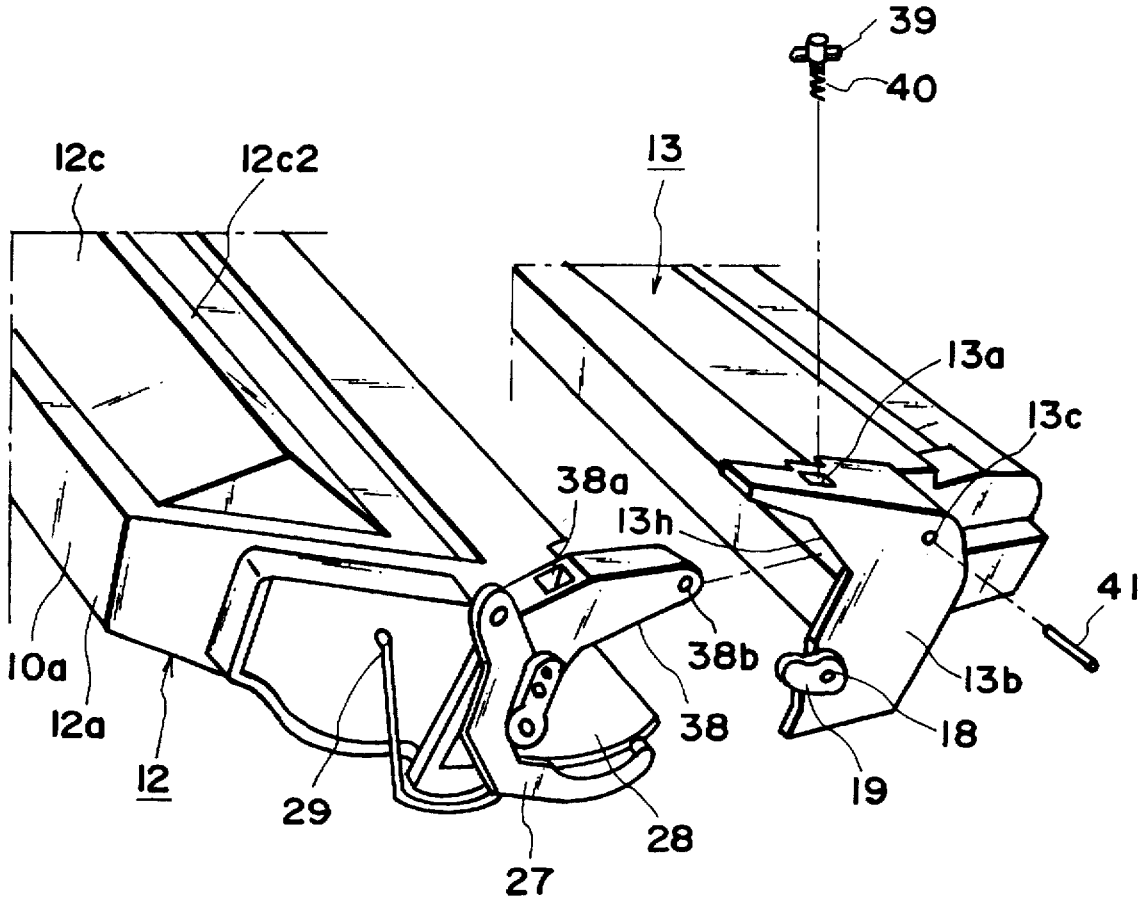
FIG. 1 is a perspective view depicting how a development frame and a cleaning frame are joined.
Figure 2:
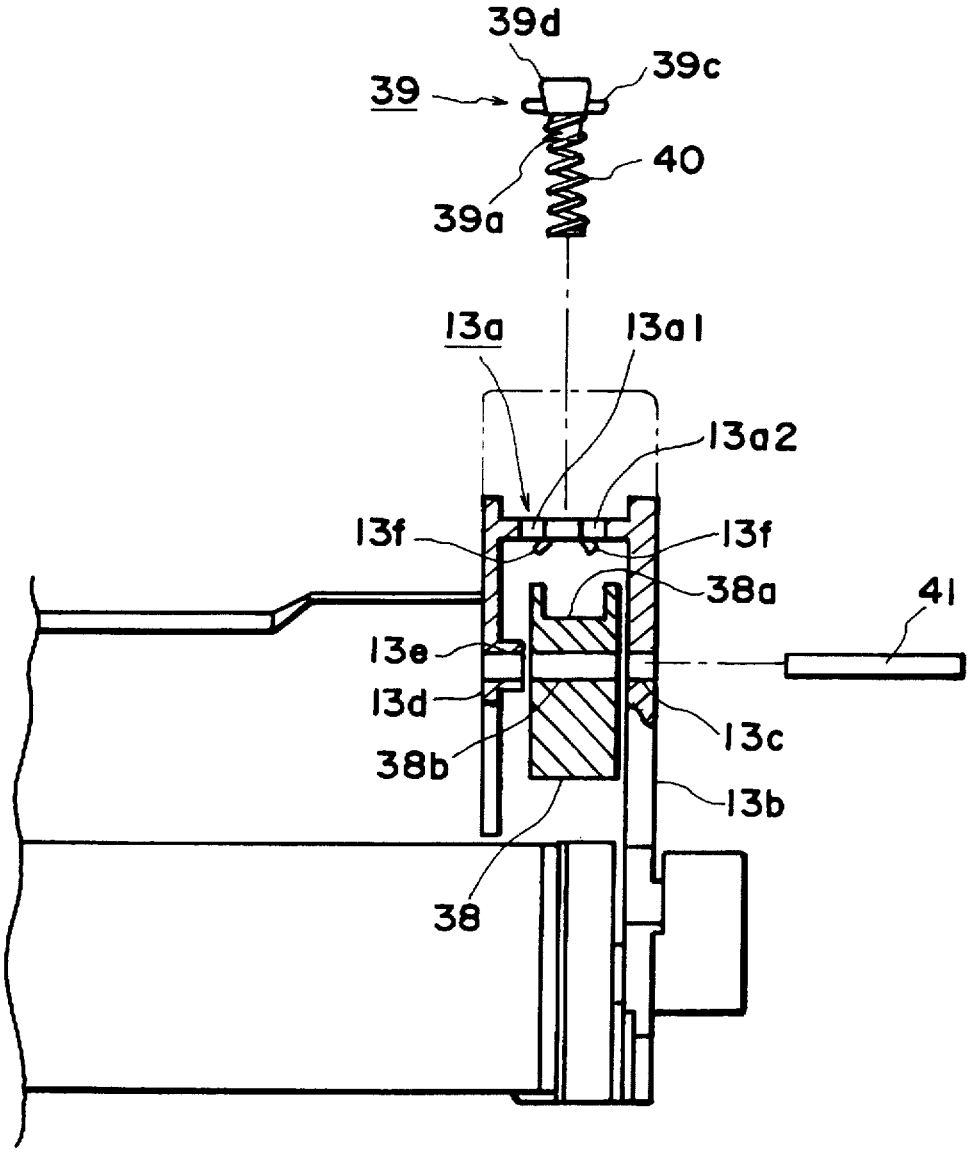
FIG. 2 is a sectional view depicting the internal structure of the joint between the development frame and the cleaning frame.
Figure 3:
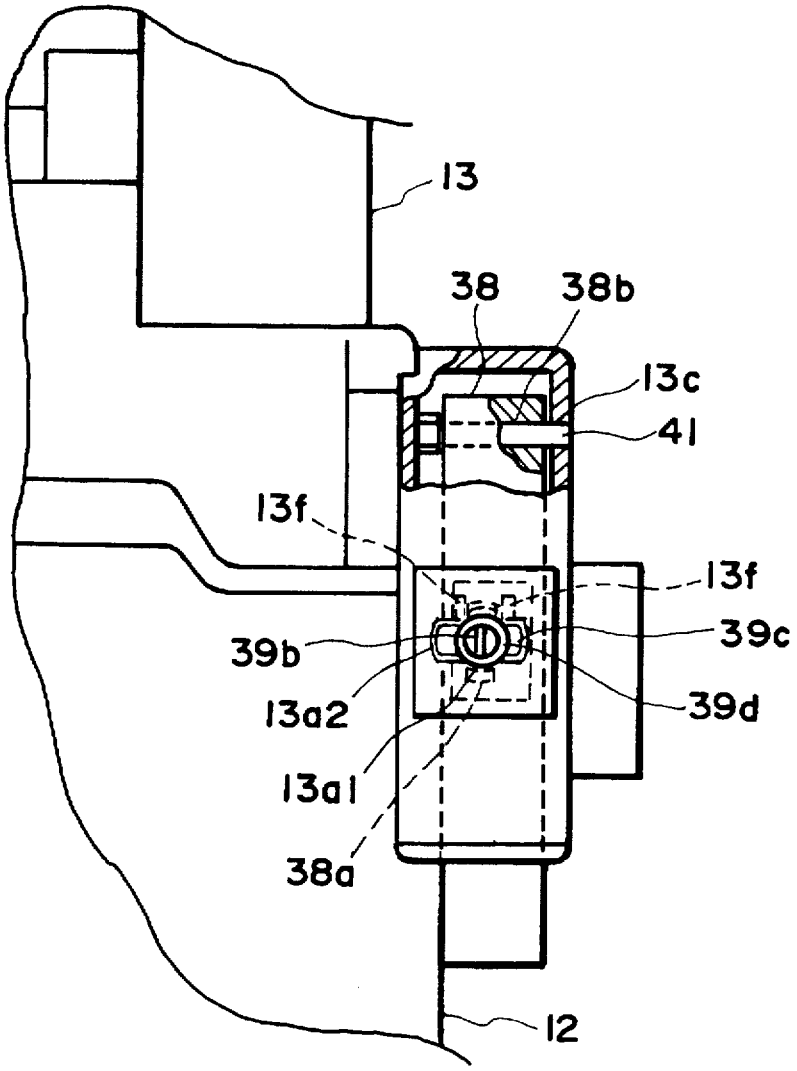
FIG. 3 is a partially cutaway plan view of the joint between the development frame and the cleaning frame.

Next, referring to FIGS. 1–3, the structure for joining the development frame 12 and the cleaning frame 13 will be described. FIG. 1 is a perspective view of both frames 12 and 13, depicting how they are joined. FIG. 2 depicts the internal structure of the joint, and FIG. 3 is a partially cutaway schematic plan view of the joint. The structures of the left and right joints at which the frames 12 and 13 are rotatively connected to each other with the arm portions 38 are the same; therefore, the structure on only one side will be described.

Referring to FIGS. 2 and 3, in order to give some elastic flexibility to the angle formed between the development frame 12 and the cleaning frame 13, the process cartridge B is provided with a compression spring 40, which is attached to a compression spring anchoring member 39 which integrally comprises a spring attachment portion 39a and a cylindrical portion 39d. The cylindrical portion 39d has a larger diameter than the diameter of the compression spring 40 attached to the spring attachment portion 39a. The head portion of the cylindrical portion is provided with a rib 39b, and the peripheral surface of the cylindrical portion 39d is provided with two flanges 39c.

The upward facing surface of the arm portion 38 of the development frame 12 is provided with a recess 38*a* (receiving portion). The location of the recess 38*a* is such that after the development frame 12 and the cleaning frame 13 are rotatively joined as will be described later, the recess 38*a* is located right below the attachment hole 13*a* of the cleaning frame 13. Further, a through hole 38*b* through which a pin 41 is put is provided at the tip portion of the arm portion 38. The pin 41 will be described later.

On the other hand, the cleaning frame 13 is provided with an attachment hole 13*a* into which the aforementioned spring anchoring member 39 is pressed. Referring to FIGS. 2 and 3, the attachment hole 13*a* is constituted of a cylindrical hole portion 13*a*1 slightly larger than the flange 39*c* or the cylindrical portion 39*d* of the spring anchoring member 39, and a cutaway portion 13*a*2. The external wall 13*b* of the cleaning frame 13 is provided with a hole 13*c* through which the pin 41 is put, and the internal wall 13*d* of the cleaning frame 13 is provided with a hole 13*e* into which the pin 41 is pressed. The axial lines of the holes 13*c* and 13*e* coincide with each other, and are parallel to the axial lines of the holes 13*c* and 13*e* provided on the other side, relative to the longitudinal direction, of the cleaning frame 13. Further, a rib 13*f* is provided on the interior surface of the cleaning frame 13, adjacent to the attachment hole 13*a*.

Referring to FIGS. 2 and 3, when the development frame 12 and cleaning frame 13 are joined using the above structure, first, the arm portion 38 of the development frame 12 is inserted into the joining portion 13*h* of the cleaning frame 13. Next, the pin 41 is put through the hole 13*c* of the cleaning frame 13, and the through hole 38*b* of the arm portion 38, in this order, and then is pressed into the hole 13*e*. As a result, the development frame 12 and cleaning frame 13 are Joined in such a manner that they are rotatable about the pin 41. At this stage of the process cartridge B assembly, no pressure is present to press the photosensitive drum 7 and development roller 10*d* toward each other; therefore, assembly workers can easily examine the degree of the rotatability of both components.

Next, referring to FIG. 2, the spring anchoring member 39 to which the spring 40 has been attached is put through the attachment hole 13*a*; the cutaway portion 13*a*2 of the attachment hole 13*a*, and the flange 39*c* of the spring anchoring member 39, are aligned, with the tip of the spring 40 placed in contact with the bottom surface of the recess 38*a*, and the spring anchoring member 39 is pressed straight down in the compressing direction of the spring 40 until the upper surface of the flange 39*c* of the spring anchoring member 39 comes to be located below the rib 13*f*, and the cylindrical portion 39*d* comes to be guided by the cylindrical hole portion 13*a*1 of the attachment hole 13*a*. In this state, the spring anchoring member 39 is rotated 90°, and is released. Consequently, the spring anchoring member 39 is pushed up, being guided by the cylindrical hole portion 13*a*1, by the resiliency of the spring 40, and is stopped at a point at which the flange 39*c* strikes the bottom edge of the attachment hole 13*a*.

As a result, the development roller 10*d* mounted in the development frame 12 is pressed toward the photosensitive drum 7 mounted in the cleaning frame 13, coming in contact with the ring members (unillustrated) as spacers mounted at the longitudinal ends of the development roller 10*d*, and thereby coming to be accurately positioned relative to the photosensitive drum 7. At the same time, the drum gear fixed to the longitudinal end of the photosensitive drum 7 becomes engaged with a roller gear fixed to the longitudinal end of the development roller 10*d*, enabling the driving force to be transmitted.

Process Cartridge

The aforementioned process cartridge B has the following structure. The process cartridge B removably installable in the main assembly of an image forming apparatus A comprises a drum frame 13 (cleaning frame), a development frame 12, a toner frame 12*a*. The drum frame 13 houses a electro-photographic photosensitive drum 7, a charger 8 charging the electro-photographic photosensitive drum 7, a cleaning blade 11*a* for removing the toner remaining on the electro-photographic photosensitive drum 7, wherein the charger 8 is in contact with the electro-photographic photosensitive drum 7, and the cleaning blade 11*a* is in contact with the electro-photographic photosensitive drum 7. The development frame 12 houses a development roller 10*d* for developing the latent image formed on the electro-photographic photosensitive drum 7, and the toner frame 12*a* comprises a toner holding portion 10 for holding the toner used for the aforementioned development. The tf12*a* is joined with the development frame 12 along their longitudinal edges, and also supports an arm portion 38. The arm portion 38 is disposed at each longitudinal end of the toner frame 12*a* and projects toward the drum frame 13 in the direction perpendicular to the longitudinal direction thereof, enabling the development frame 12 and the development frame 13 to be joined so as to be oscillatable relative to each other. Also, the toner frame 12*a* comprises handhold portions 12*a*10 and 12*c*2 for holding the process cartridge B. They are located on the opposite side of the toner frame 12*a* relative to the development frame 13. The handhold portions 12*a*10 and 12*c*2 are partially constituted of the lid 12*c* of the toner holding portion 10*a* of the 12*a*; therefore, they become the part of the toner frame 12*a* as the lid 12*c* is attached to the toner frame 12*a*. Further, the toner frame 12*a* is provided with a toner filling opening 12*a*2 through which the toner is filled, and a toner supply opening 12*a*1 for supplying to the development roller 10*d* the toner held in the toner holding portion 10*a*, and a toner seal mount 12*a*5 on which a toner seal 31 is attached. the toner filling opening 12*a*2 is located at one of the longitudinal ends of the toner frame 12*a*, and the toner supply opening 12*a*1 and the toner seal mount 12*a*5 extend in the longitudinal direction of the toner frame 12*a*. The toner seal 31 unsealably seals the toner supply opening 12*a*1. The toner frame 12*a* and the development frame 12 are joined by a pin 41 placed through a hole 38*b* of the arm portion 38, and holes 13*c* and 13*e* of the development frame 13, wherein the development frame 12 joined with the toner frame 12*a*, and the development frame 13, are rotatable about the pin 41.

In other words, in this embodiment, after the first frame 12 and second frame 13 are rotatively joined, and the degree of the rotatability of the photosensitive drum 7 and development roller 10*d* is confirmed, the photosensitive drum 7 and the development roller 10*d* are pressed toward each other by the spring 40 anchored by the spring anchoring member 39; therefore, the possibility of the fluctuation of the pressure applied to the photosensitive drum 7 by the development roller 10*d* is eliminated. Further, the spring anchoring member 39 is attached so as to keep appropriately compressed the compression spring 40 attached to the spring anchoring member 39; therefore, the compression spring 40 is not liable to buckle. Further, the spring anchoring member 39 can be replaced without removing the spring cover. In other words, the spring anchoring member 39 can be replaced, the first and second frames 12 and 13 remaining connected, enabling the spring anchoring member 39 to be exchanged with a spring anchoring member with a spring having a proper pressure, substantially regardless of the cartridge assembling order.

Consequently, the assembly efficiency for the process cartridge B is improved. In addition, when an image is formed using the process cartridge B described above, the pressure applied by the development roller 10*d* does not fluctuate as described above; therefore, a high quality image can be produced.

Other Embodiment

Next, various components of the process cartridge B and the image forming apparatus in accordance with the present invention will be described.

In the preceding embodiment, one of the arm portions 38 for connecting the development frame 12 and the cleaning frame 13 was disposed on the gear cover 37, and this gear cover 37 was fixed to one of the longitudinal ends of the development frame 12, but both arm portions 38 may be directly formed on the toner holding frame portion 12*a*. This arrangement can also effectively disperse the shock generated during the installation of the process cartridge B.

Further, in the preceding embodiment, the link supporting member 30 was welded to the cartridge frame, but the link supporting member 30 may be screwed to the cartridge frame, or may be glued to the cartridge frame with adhesive.

Internal Structure of Toner Holding Frame

Figure 21:
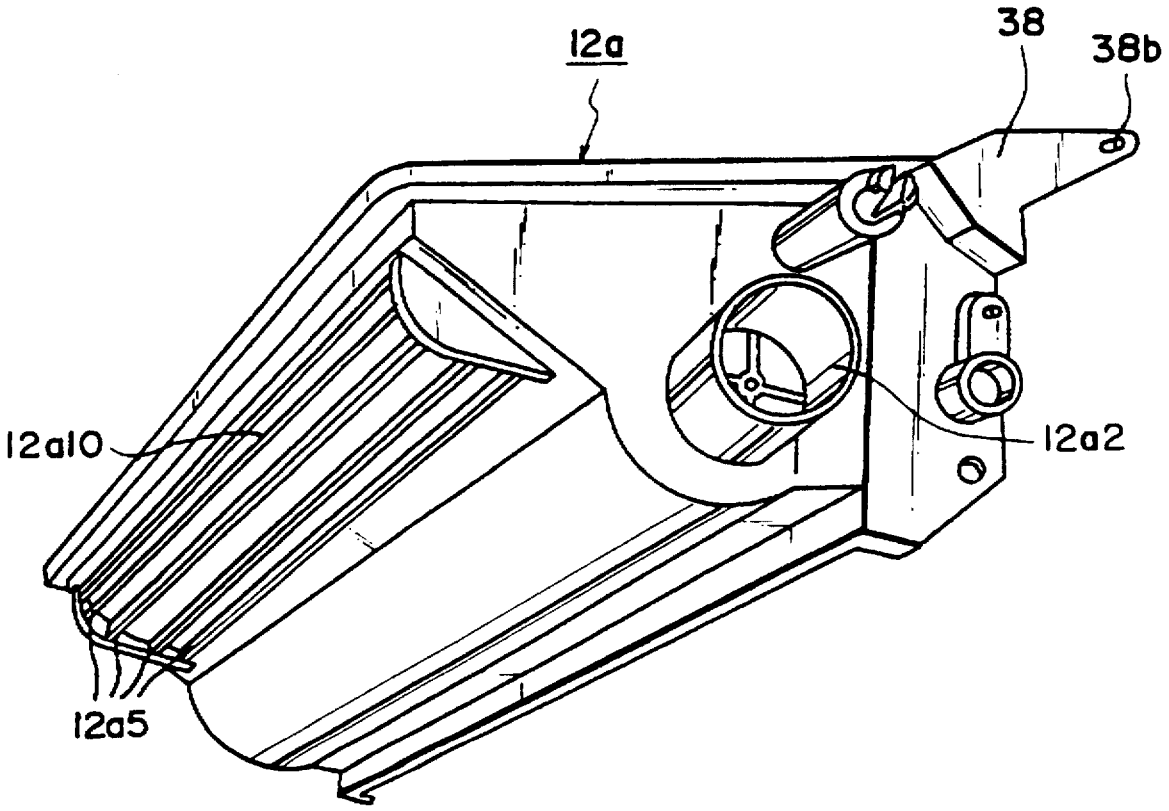
FIG. 21 is a perspective view of a toner accommodating container.
Figure 22:
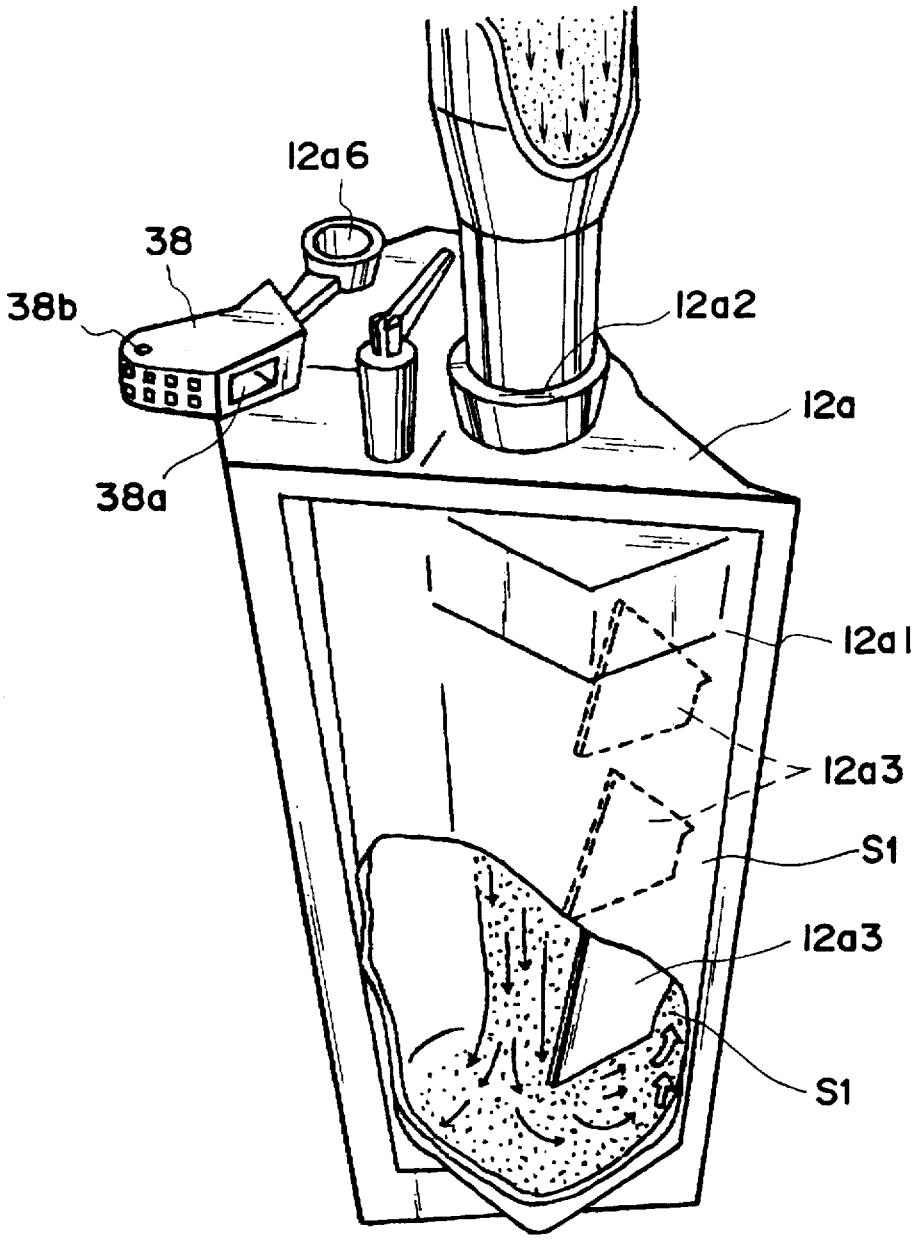
FIG. 22 is a perspective view thereof when the toner is filled.

Next, referring to FIGS. 21 and 22, the internal structure of the toner holding frame portion 12*a* will be described. As will be become clear from the following description, partition members 12*a*3 are provided within the toner holding frame portion 12*a*, wherein a gap is provided between the partition member 12*a*3 and the frame lid 12*c*. This arrangement is made so that even when the frame lid 12*c* is flexed as the users too firmly grasp the toner holding frame portion 12*a* of process cartridge B, the flexed portion of the frame lid 12*c* can be supported by the top surface of the partition member 12*a*3.

A gap is also provided between the partition member 12*a*3 and the toner holding portion 10*a*. This arrangement is made so that the toner poured into the toner holding portion 10*a* through the toner filling opening 12*a*2 can be delivered with preferable efficiency into each of the spaces partitioned by the partition members 12*a*3 in spite of the presence of the partition members 12*a*3.

Figure 9:
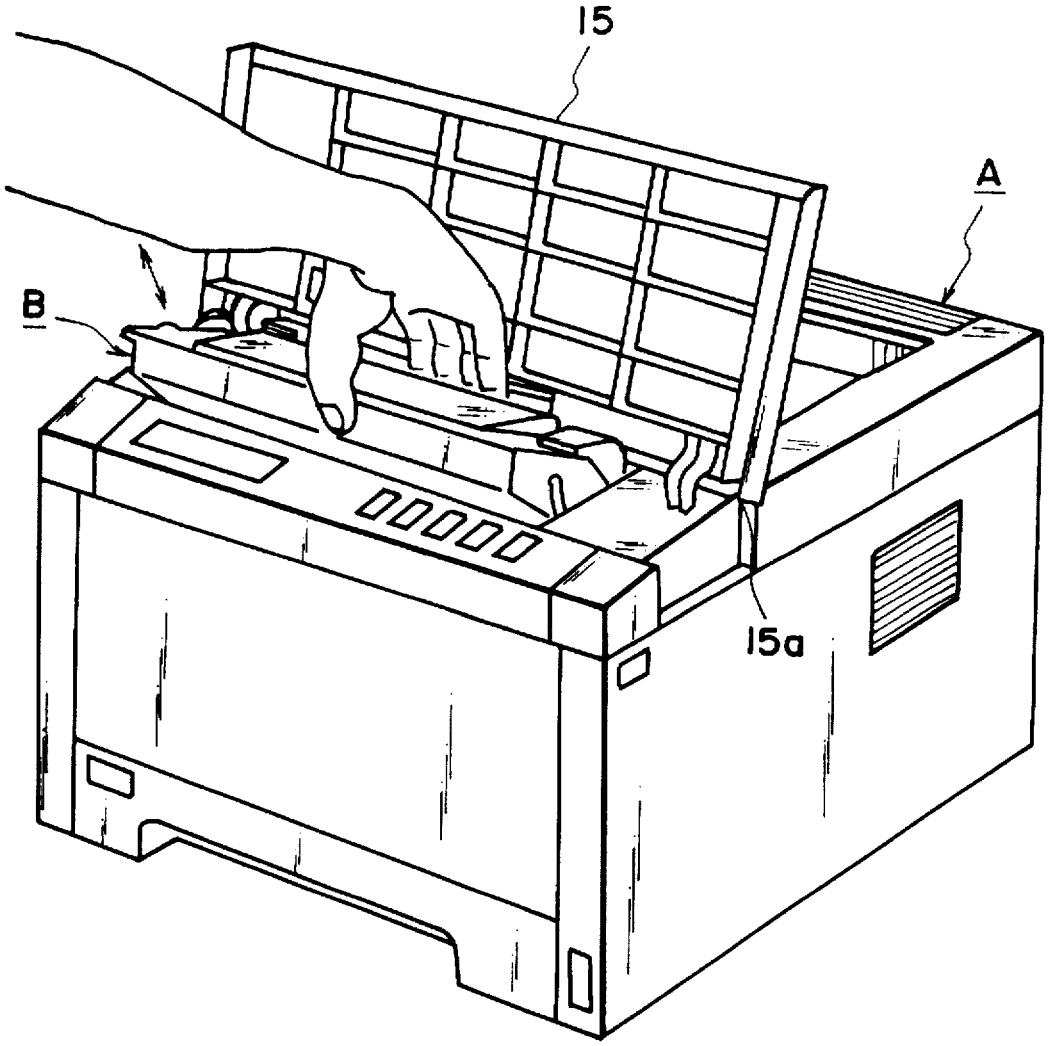
FIG. 9 is a perspective view depicting how the process cartridge is installed into the image forming apparatus.
Figure 10:
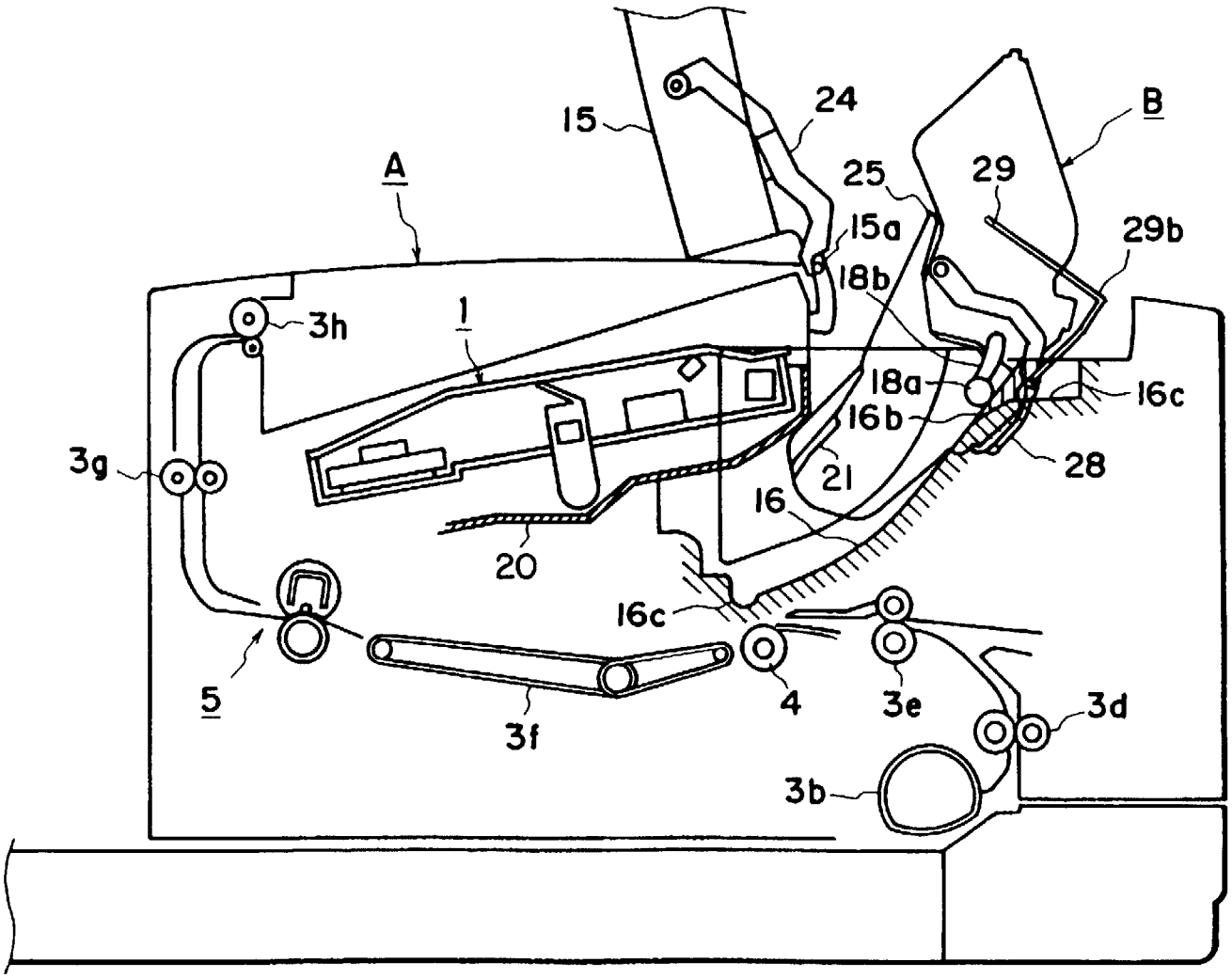
FIG. 10 is a sectional explanatory drawing depicting the state of the process cartridge having been partially inserted into the image forming apparatus.

Referring to FIG. 16, the slant surface on the top of the frame lid 12*c* is provided with several parallel ribs 12*c*1, constituting a handhold portion 12*c*2. Further, referring to FIG. 21, the bottom portion of the toner holding frame portion 12*a* is provided with an R portion which bulges downward. The external surface of the R portion is also provided with several parallel ribs 12*a*5, constituting a handhold portion 12*a*10. The users can easily hold the process cartridge B by grasping the handhold portions 12*a*10 and 12*c*2, so that the process cartridge B can be smoothly installed into, or removed from, the image forming apparatus A (FIG. 9).

At this time, the relationship between the partition member 12*a*3 provided within the toner holding portion 10*a*, and the frame wall surface will be described. Referring to FIG. 5, a gap S1 is provided between the rear edge of the partition member 12*a*3 and the internal surface of the rear wall of the toner holding frame portion 12*a* ("rear" relative to the direction in which the toner within the toner holding portion 10*a* is supplied to the development roller 10*d*). Also, a minute gap S2 is provided between the top end of the partition member 12*a*3 and the internal surface of the frame lid 12*c*.

The purpose of the partition member 12*a*3 is to minimize the deformation of the toner holding frame portion 12*a* and the frame lid 12*c* when excessive pressure is applied by the users who handle the process cartridge B by gripping the handhold portions 12*c*2 and 12*a*10. In other words, even if the users too firmly grasp the process cartridge B, and consequently, the toner holding frame portion 12*a* and/or the frame lid 12*c* become deformed, the top end of the partition member 12*a*3 and the internal surface of the frame lid 12*c* come in contact with each other, regulating the amount of the deformation.

With the presence of the partition members 12*a*3 within the toner holding portion 10*a*, unless the internal air of the toner holding portion 10*a* is properly released while the toner is filled, the toner cannot be filled with sufficiently high density.

Thus, in this embodiment, the gap S1 is provided between the partition member 12*a*3 and the internal surface of the rear wall of the toner holding frame portion 12*a* as described above. Consequently, when the toner is filled through the toner filling opening 12*a*2, the internal air of the toner holding portion 10*a* is allowed to flow through the gap S1 and out of the toner holding portion 10*a* as illustrated in FIG. 22 (a black arrow mark indicates the toner flow, and a white arrow mark indicates the air flow). As a result, the toner can be smoothly filled into the toner holding portion 10*a*, with a sufficient density.

It should be noted here that in order to provide a proper balance between the air releasing efficiency and the effectiveness in regulating the frame deformation, the gap S1 is preferred to be 5 mm –20 mm.

Also as described before, in this embodiment, the gap S2 is provided between the top end of the partition member 12*a*3 and the frame lid 12*c*; therefore, the generation of burr is prevented. More specifically, when the frame lid 12*c* is attached to the toner holding frame portion 12*a* without providing the gap S2, the top end of the partition member 12*a*3 and the internal surface of the frame lid 12*c* sometimes make contact due to manufacturing error. If the toner holding frame portion 12*a* and the frame lid 12*c* are welded together by ultrasonic welding when the partition member 12*a*3 and the frame lid 12*c* are in contact with each other, the burr may be generated between the top end of the partition member 12*a*3 and the internal wall of the frame lid 12*c*, and when generated, the burr is liable to drop into the toner holding portion 10*a*, and mix with the toner, forming a toner nucleus, during the transportation of the process cartridge B, or in the like situation. But, according to the present invention, the generation of the burr can be prevented.

On the other hand, when the gap S2 is too large, the internal pressure of the toner holding portion 10*a* is liable to increase. This is because when the handhold portion formed on the frame lid 12*c* welded to the toner holding frame portion 12*a* using ultrasonic welding is firmly gripped, the presence of an excessive gap is liable to allow both frame portions to deform. Thus, the size of the gap S2 is preferred to be set within a range of 0.0–0.5 mm so that when the handhold portions are firmly gripped, the deformation of the toner holding frame portion 12*a* and the frame lid 12*c* can be minimized. In this embodiment, the gap S2 is set at 0.2 mm.

As is evident from the above descriptions, not only does the provision of the gaps S1 and S2 between the partition member 12*a*3 and the internal surface of the frame allow the toner to be filled with high density, but also, prevents the burr from mixing into the toner, and minimizes the frame deformation.

A process cartridge B is detachably mountable to a main assembly of an image forming apparatus, and comprises: a. an electrophotographic photosensitive drum 7; b. a developing roller 10*d* for developing a latent image formed on the electrophotographic photosensitive drum 7, the developing roller supplying toner to the electrophotographic photosensitive drum 7 by rotation thereof; c. a charging roller 8 for charging the electrophotographic photosensitive drum 7, the charging roller 8 being contacted to the electrophotographic photosensitive drum 7; d. a cleaning blade 11*a* for removing residual toner from the electrophotographic photosensitive drum 7; e. a toner accommodating container 12*a*, including: a toner accommodating portion 10*a* for accommodating toner usable for developing a latent image formed on the electrophotographic photosensitive drum 7, wherein the toner accommodating portion 10*a* is provided with a toner supply opening 12*a*1 for supplying the toner to the electrophotographic photosensitive drum 7 from the toner accommodating portion 10*a;* a partition wall 12*a*3 extending in the toner accommodating portion in a direction along a short side of the toner accommodating portion to define a plurality of space therein, wherein the toner accommodating portion has a bottom surface slanted down toward the toner supply opening, and the partition is provided on the slanted surface; a toner filling opening 12*a*2, at a longitudinal end of the toner accommodating portion, for permitting toner to b filled into the toner accommodating portion; and a through-passage S1 extending from one longitudinal end to the other longitudinal end along a length of the toner accommodating portion so as to permit the toner to be supplied into the spaces, the through-passage being formed between a wall surface of the toner accommodating portion and the partition wall, wherein the through-passage S1 is provided between a rear wall surface opposed to the toner supply opening and the partition wall.

Also, a process cartridge B is detachably mountable to a main assembly of an image forming apparatus, and comprises: a. an electrophotographic photosensitive drum 7; b. a developing roller 10*d* for developing a latent image formed on the electrophotographic photosensitive drum 7, the developing roller supplying toner to the electrophotographic photosensitive drum 7 by rotation thereof; c. a charging roller 8 for charging the electrophotographic photosensitive drum 7, the charging roller 8 being contacted to the electrophotographic photosensitive drum 7; d. a cleaning blade 11*a* for removing residual toner from the electrophotographic photosensitive drum 7; e. a toner accommodating container 12*a*, including: a toner accommodating portion 10*a* for accommodating toner usable for developing a latent image formed on the electrophotographic photosensitive drum 7, wherein the toner accommodating portion 10*a* is provided with a toner supply opening 12*a*1 for supplying the toner to the electrophotographic photosensitive drum 7 from the toner accommodating portion 10*a;* a cover member 12*c* for covering an opening other than the toner supply opening 12*a*1, wherein the cover member 12*c* covers the opening provided at an upper portion of the toner accommodating portion 10*a*, which portion takes an upper position when the process cartridge is mounted on the main assembly of the image forming apparatus; a handle portion 12*c*2 on the cover member 12*c* for facilitating handling of the toner accommodating container, wherein the handle 12*c*2 has a plurality of ribs 12*c*1. The outer surface of the toner accommodating container has a plurality of ribs 12*a*9. When the container 12*a* is handled, the rib of the cover and the rib of the container 10*a*.

In order to fill the toner into the portion 10*a*, there are provided a toner filling opening 12*a*2 at one longitudinal end of the accommodating portion, the partition wall 12*a*3 for partitioning the inside space of the portion 10*a*. A gap S2 is formed between the cover member 12*c* and the partition wall 12*a*3. When the cover bends upon gripping the toner accommodating container, the partition wall 12*a*3 and the cover 12*c* are contactable. The gap S2 between the partition wall 12*a*3 and the cover 12*c* is not more than approx. 0.5 mm. The toner accommodating portion 10*a* and the cover 12*c* are welded.

Further, the aforementioned process cartridge B was of a type for forming a monochromatic image. However, not only is the present invention preferably applicable to the process cartridge which forms a monochromatic image, but also to a cartridge which comprises two or more developing means, and forms a multi-color image (for example, a two-color image, a three-color image, a full-color image, and the like).

As for the developing method, various known development methods such as the magnetic brush development method employing two component toner, the cascade development method, the touch down development method, or cloud development method may be employed.

The electro-photographic photosensitive member is not limited to the photosensitive drum. For example, the following may be included.

First, as the photosensitive material, photoconductive material such as amorphous silicon, amorphous selenium, zinc oxide, titanium oxide, or organic photoconductor (OPC) may be included. As for the shape of the base member on which the photosensitive material is placed, a rotary member such as a drum or a member in the form of a sheet such as an endless belt, are included. Generally, a member in the form of a drum or a belt is employed. For example, a photosensitive drum comprises a cylinder of aluminum alloy or the like, and photoconductive material deposited or coated thereon.

The structure of the charging means described in the preceding embodiment was of the so-called contact type, but it is obvious that other conventional structures may be employed, for example, a structure in which a tungsten wire is surrounded on three sides by a shield of metallic material such as aluminum, and positive or negative ions generated by applying a high voltage to the tungsten wire are transferred onto the surface of the photosensitive drum to uniformly charge the drum surface.

As for the charging means, a charging means of the blade type (charging blade), the pad type, the block type, the rod type, the wire type, or the like may be employed in addition to the roller type charging means described in the preceding embodiment.

Regarding the method for cleaning the toner remaining on the photosensitive drum, the cleaning means may comprise a blade, a fur brush, a magnetic brush, or the like.

The process cartridge in accordance with the present invention comprises at least an electro-photographic photosensitive member and a developing means. Typically, a combination of a developing means, an electro-photographic photosensitive member, a charging means, and a cleaning means, a combination of a developing means, an electro-photographic photosensitive member, and a charging means or a cleaning means, a combination of a developing means and an electro-photographic photosensitive member, or the like combination is integrated in the form of a cartridge so that it can be removably installed into the main assembly of an apparatus.

Further, in the preceding embodiment, the image forming apparatus was represented by a laser beam printer, but the present invention is not limited by the preceding embodiment. Obviously, the present invention is also applicable to other image forming apparatuses such as an electrophotographic copying machine, a facsimile apparatus, or a word processor.

As described above, according to the present invention, the drum frame and the development frame are joined so as to be rotatable relative to each other, and a pressure can be applied to both frames after the degree of the rotatability of the electro-photographic photosensitive drum and the developing members is confirmed; therefore, the fluctuation of the pressure applied to the electro-photographic photosensitive drum by the developing member is eliminated. As a result, a high quality image can be obtained.

Further, the spring anchoring member is attached by pressing it in the direction which compresses the compression spring; therefore, the anchored spring is not liable to buckle. Further, when the spring anchoring member needs to be replaced, it is unnecessary to remove the cover or the like; therefore, the process cartridge assembling efficiency can be improved.

While the invention has been described with reference to the structures disclosed herein, it is not confined to the details set forth, and this application is intended to cover such modifications or changes as may come within the purposes of the improvements or the scope of the following claims.

What is claimed is:

1. An assembling method of a process cartridge detachably mountable to a main assembly of an image forming apparatus, comprising the steps of:

a. preparing a drum frame to which an electrophotographic photosensitive drum is mounted;

b. preparing a developing frame having a toner accommodating portion for accommodating toner for developing a latent image formed on said electrophotographic photosensitive drum and also having developing means, mounted thereto, for developing the latent image formed on said electrophotographic photosensitive drum, using toner accommodated in said toner accommodating portion;

c. engaging a portion of said drum frame and a portion of said developing frame;

d. coupling a coupling member with a portion where said drum frame and said developing frame are engaged to couple said drum frame and developing frame, wherein said drum frame and said developing frame are rotatable relative to each other about said coupling member; and e. spring mounting a compression spring by locking a base member by rotating said base member having said compression spring mounted thereto.

2. A method according to claim 1, wherein said developing frame is provided by coupling a toner frame provided with said toner accommodating portion and a developing roller mounting frame for mounting a developing roller as said developing means.

3. A method according to claim 2, wherein said toner frame and said developing roller mounting frame are coupled by welding.

4. A method according to claim 1, wherein said engaging step includes engaging an engaging portion of said drum frame with an arm portion of said developing frame provided above a portion to which a developing roller as said developing means is mounted.

5. A method according to claim 4, wherein said developing frame is provided by coupling a toner frame provided with said toner accommodating portion and a developing roller mounting frame for mounting a developing roller as said developing means, wherein said arm portion is provided at each of one and the other longitudinal ends of said toner frame, and wherein said arm portion is provided at the one end on a gear cover mounted to said toner frame so as to cover a gear mounted to said toner frame, and said arm portion provided at the other end is integral with said toner frame having said toner accommodating portion.

6. A method according to claim 4 or 5, wherein said coupling step includes inserting a pin as said coupling member, from outside of said drum frame, through a hole provided in said arm portion of said developing frame and through a hole provided in said engaging portion of said drum frame, wherein said pin is inserted in a longitudinal direction of said photosensitive drum.

7. A method according to claim 4 or 5, wherein said spring mounting step includes inserting said compression spring and a locking member which are made integral through a hole provided in said drum frame to a receptor portion provided in said developing frame, and then rotating said locking member to lock said locking member to said drum frame to provide an elastic force between said drum frame and said developing frame by said compression spring.

8. A method according to claim 1, wherein said base member includes:

a base provided with a rib;

a compression spring mounting portion provided in said base; and, a flange provided at a side of said base, wherein said flange is to be mounted to the drum frame of the process cartridge.

9. An assembling method of a process cartridge detachably mountable to a main assembly of an image forming apparatus, comprising the steps of:

a. preparing a drum frame to which an electrophotographic photosensitive drum and a charging member for charging said electrophotographic photosensitive drum are mounted;

b. preparing a developing frame having a toner accommodating portion for accommodating toner for developing a latent image formed on said electrophotographic photosensitive drum and also having a developing roller, mounted thereto, for developing the latent image formed on said electrophotographic photosensitive drum, using toner accommodated in said toner accommodating portion, wherein said developing roller supplies toner to said electrophotographic photosensitive drum;

c. engaging an engaging portion of said drum frame and an arm portion of said developing frame provided above a portion to which said developing roller is mounted;

d. coupling the engaging portion of said drum frame with the arm portion of said developing frame by a pin to couple said drum frame and said developing frame, wherein said drum frame and said developing frame are rotatable relative to each other about the pin; and e. spring mounting a compression spring mounted to a locking member, by locking said locking member into said drum frame by inserting through a hole in said drum frame by insertion through a hole in said drum frame and locking said locking member into said drum frame by rotating said locking member to applying an elastic force to said drum frame and said developing frame thus coupled.

10. A method according to claim 9, wherein said developing frame is provided by coupling a toner frame provided with said toner accommodating portion and a developing roller mounting frame for mounting the developing roller.

11. A method according to claim 10, wherein said developing frame and said developing roller mounting frame are coupled by welding.

12. A method according to claim 9, wherein said developing frame is provided by coupling a toner frame provided with said toner accommodating portion and a developing roller mounting frame for mounting said developing roller, wherein said arm portion is provided at each of one and the other longitudinal ends of said toner frame, and wherein said arm portion is provided at the one end on a gear cover mounted to said toner frame so as to cover a gear mounted to said toner frame, and said arm portion provided at the other end is integral with said toner frame having said toner accommodating portion.

13. A method according to claim 9, wherein said coupling step includes inserting a pin, from outside of said drum frame, through a hole provided in said arm portion of said developing frame and through a hole provided in said engaging portion of said drum frame, wherein said pin is inserted in a longitudinal direction of said photosensitive drum.

14. A method according to claim 9, wherein said spring mounting step includes inserting said compression spring and said locking member which are made integral through a hole provided in said drum frame to a receptor portion provided in said developing frame, and then rotating said locking member to lock said locking member to said drum frame to provide the elastic force between said drum frame and developing frame by said compression spring.

15. A method according to claim 9, wherein said locking member includes:

a base provided with a rib;

a compression spring mounting portion provided in said base; and, a flange provided at a side of said base, wherein said flange is to be mounted to the drum frame of the process cartridge.

16. An assembling method of a process cartridge detachably mountable to a main assembly of an image forming apparatus, comprising the steps of:

a. preparing a drum frame to which an electrophotographic photosensitive drum, a charging member, contacted to said electrophotographic photosensitive drum, for charging said electrophotographic photosensitive drum, a cleaning blade, contacted to said electrophotographic photosensitive drum, for removing residual toner from said electrophotographic photosensitive drum, are mounted;

b. preparing a developing frame having a toner accommodating portion for accommodating toner for developing a latent image formed on said electrophotographic photosensitive drum and also having a developing roller, mounted thereto, for developing the latent image formed on said electrophotographic photosensitive drum, using toner accommodated in said toner accommodating portion, wherein said developing roller supplies toner to said electrophotographic photosensitive drum, wherein said developing frame is provided by coupling a toner frame provided with said toner accommodating portion and a developing roller mounting frame for mounting said developing roller.

c. engaging an engaging portion of said drum frame and an arm portion of said developing frame provided above a portion to which said developing roller is mounted, wherein said arm portion is provided at each of one and the other longitudinal ends of said toner frame, and wherein said arm portion is provided at the one end on a gear cover mounted to said toner frame so as to cover a gear mounted to said toner frame, and said arm portion provided at the other end is integral with said toner frame having said toner accommodating portion;

d. coupling said engaging portion of said drum frame with said arm portion of said developing frame by inserting a pin to couple said drum frame and said developing frame, wherein said drum frame and said developing frame are rotatable relative to each other about said pin; and e. spring mounting a compression spring mounted to a locking member, by locking said locking member into said drum frame by insertion through a hole in said drum frame to apply an elastic force to said drum frame and said developing frame thus coupled, wherein said spring mounting step includes inserting said compression spring and said locking member mounted thereto through a hole provided in said drum frame to a receptor portion provided in said developing frame, and then rotating said locking member to lock said locking member to said drum frame to provide the elastic force between said drum frame and said developing frame by said compression spring.

17. A method according to claim 16, wherein toner frame and said developing roller supporting frame are coupled by welding.

18. A method according to claim 16, wherein said locking member includes:

a base provided with a rib;

a compression spring mounting portion provided in said base; and, a flange provided at a side of said base, wherein said flange is to be mounted to the drum frame of the process cartridge.

19. A process cartridge detachably mountable to a main assembly of an image forming apparatus, comprising:

an electrophotographic photosensitive drum;

a developing means for developing a latent image formed on said electrophotographic photosensitive drum;

a toner accommodating portion for accommodating toner to be used by said developing means for development;

a drum frame for supporting said electrophotographic photosensitive drum;

a developing frame for supporting said developing means, said developing frame supporting said toner accommodating portion;

a coupling member for coupling said drum frame and said developing frame, wherein said drum frame and said developing frame are rotatable relative to each other about said coupling member; and a compression spring, for applying an elastic force between said drum frame and said developing frame, wherein said compression spring is mounted by locking a base member by rotating said base member having said compression spring mounted thereto.

20. A process cartridge according to claim 19, wherein said developing frame is provided by coupling a toner frame provided with said toner accommodating portion and a developing roller mounting frame for mounting a developing roller as said developing means.

21. A process cartridge according to claim 20, wherein said toner frame and said developing roller mounting frame are coupled by welding.

22. A process cartridge according to claim 19, wherein an engaging portion of said drum frame is engaged with an arm portion of said developing frame provided above a portion to which a developing roller as said developing means is mounted.

23. A process cartridge according to claim 22, wherein said compression spring and a locking member mounted thereto is inserted through a hole provided in said drum frame to a receptor portion provided in said developing frame, and then rotating said locking member to lock said locking member to said drum frame to provide an elastic force between said drum frame and developing frame by said compression spring.

24. A process cartridge according to claim 19, wherein said developing frame is provided by coupling a toner frame provided with said toner accommodating portion and a developing roller mounting frame for mounting a developing roller as said developing means, wherein an arm portion is provided at each of one and the other longitudinal ends of said toner frame, and wherein said arm portion is provided at the one end on a gear cover mounted to said toner frame so as to cover a gear mounted to said toner frame, and said arm portion provided at the other end is integral with said toner frame having said toner accommodating portion.

25. A process cartridge according to claim 22 or 24, wherein a pin is inserted from outside of said drum frame, through a hole provided in an arm portion of said developing frame and through a hole provided in an engaging portion of said drum frame to couple said developing frame and said drum frame, wherein said pin is inserted in a longitudinal direction of said photosensitive drum.

26. A process cartridge according to claim 19, wherein said base member includes:

a base provided with a rib;

a compression spring mounting portion provided in said base; and, a flange provided at a side of said base, wherein said flange is to be mounted to the drum frame of the process cartridge.

27. A process cartridge detachably mountable to a main assembly of an image forming apparatus, comprising:

an electrophotographic photosensitive drum;

a developing roller for developing a latent image formed on said electrophotographic photosensitive drum, wherein said developing roller supplies a toner to said electrophotographic photosensitive drum by rotation thereof;

a toner accommodating portion for accommodating toner to be used by said developing roller for development;

a drum frame for supporting said electrophotographic photosensitive drum and a charging member for charging said electrophotographic photosensitive drum;

a developing frame for supporting said developing roller, said developing frame to which said toner accommodating portion is mounted;

a pin for coupling said drum frame and said developing frame, wherein an engaging portion of said drum frame is engaged with an arm portion of said developing frame provided above a portion to which said developing roller is mounted, and wherein said drum frame and said developing frame are rotatable relative to each other about said pin; and a compression spring, for applying an elastic force between said drum frame and said developing frame, wherein said compression spring is mounted to said drum frame by being mounted to a locking member having said compression spring mounted thereto by locking said locking member into said drum frame by insertion through a hole in said drum frame and locking said locking member into said drum frame by rotating said locking member to apply the elastic force to said drum frame and said developing frame thus coupled.

28. A process cartridge according to claim 27, wherein said developing frame is provided by coupling a toner frame provided with said toner accommodating portion and a developing roller mounting frame for mounting said developing roller.

29. A process cartridge according to claim 28, wherein said toner frame and said developing roller mounting frame are coupled by welding.

30. A process cartridge according to claim 27, wherein said developing frame is provided by coupling a toner frame provided with said toner accommodating portion and a developing roller mounting frame for mounting said developing roller, wherein said arm portion is provided at each of one and the other longitudinal ends of said toner frame, and wherein said arm portion is provided at the one end on a gear cover mounted to said toner frame so as to cover a gear mounted to said toner frame, and said arm portion provided at the other end is integral with said toner frame having said toner accommodating portion.

31. A process cartridge according to claim 27, wherein a pin is inserted from outside of said drum frame, through a hole provided in an arm portion of said developing frame and through a hole provided in an engaging portion of said drum frame to couple said developing frame and said drum frame, wherein said pin is inserted in a longitudinal direction of said photosensitive drum.

32. A process cartridge according to claim 27, wherein said compression spring and a locking member mounted thereto is inserted through a hole provided in said drum frame to a receptor portion provided in said developing frame, and then rotating said locking member to lock said locking member to said drum frame to provide an elastic force between said drum frame and said developing frame by said compression spring.

33. A process cartridge according to claim 27, wherein said locking member includes:

a base provided with a rib;

a compression spring mounting portion provided in said base; and, a flange provided at a side of said base, wherein said flange is to be mounted to the drum frame of the process cartridge.

34. A process cartridge detachably mountable to a main assembly of an image forming apparatus, comprising:

a. an electrophotographic photosensitive drum;

b. a charging roller, contacted to said photosensitive drum, for charging said photosensitive drum;

c. a cleaning blade, contacted to said photosensitive drum, for removing residual toner from said photosensitive drum;

d. a developing roller for developing a latent image formed on said electrophotographic photosensitive drum, wherein said developing roller supplies a toner to said electrophotographic photosensitive drum by rotation thereof;

e. a drum frame for supporting said electrophotographic photosensitive drum, charging roller and cleaning blade;

f. a toner accommodating portion for accommodating toner to be used by said developing roller for development;

g. a developing frame including a toner frame provided with said toner accommodating portion and a developing roller mounting frame to which said developing roller is mounted, wherein said toner frame and said developing roller mounting frame are coupled, and an engaging portion of said drum frame is engaged with an arm portion of said developing frame provided above a portion to which said developing roller is mounted, and wherein a pin is inserted from outside of said drum frame, through a hole provided in said arm portion of said developing frame and through a hole provided in an engaging portion of said drum frame to couple said developing frame and said drum frame; and h. a pin for coupling said drum frame and said developing frame, wherein an engaging portion of said drum frame is engaged with said arm portion of said developing frame is provided above a portion to which said developing roller is mounted, and wherein said arm portion is provided at the one end on a gear cover mounted to said toner frame so as to cover a gear mounted to said toner frame, and said arm portion provided at the other end is integral with said toner frame, wherein a pin is inserted from outside of said drum frame, through a hole provided in said arm portion of said developing frame and through a hole provided in an engaging portion of said drum frame to couple said developing frame and said drum frame, wherein said pin is inserted in a longitudinal direction of said photosensitive drum, wherein said drum frame and said developing frame are rotatable relative to each about said pin; and i. a compression spring for applying an elastic force between said drum frame and said developing frame, wherein said compression spring is mounted to said drum frame by being mounted to a locking member having said compression spring mounted thereto, by locking said locking member into said drum frame by insertion through a hole in said drum frame and locking said locking member into said drum frame by rotating said locking member.

35. An apparatus according to claim 34, wherein said toner frame and said developing roller mounting frame are coupled by welding.

36. A process cartridge according to claim 34, wherein said locking member includes:

a base provided with a rib;

a compression spring mounting portion provided in said base; and, a flange provided at a side of said base, wherein said flange is to be mounted to the drum frame of the process cartridge.

37. An electrophotographic image forming apparatus for forming an image on a recording material, wherein a process cartridge is detachably mountable to said image forming apparatus, comprising:

a. mounting means for detachably mounting a process cartridge;

said process cartridge including:

an electrophotographic photosensitive drum;

a developing means for developing a latent image formed on said electrophotographic photosensitive drum;

a toner accommodating portion for accommodating toner to be used by said developing means for development;

a drum frame for supporting said electrophotographic photosensitive drum;

a developing frame for supporting said developing means, said developing frame supporting said toner accommodating portion;

a coupling member for coupling said drum frame and said developing frame, wherein said drum frame and said developing frame are rotatable relative to each about said coupling member;

a compression spring, for applying an elastic force between said drum frame and said developing frame when said compression spring is mounted by locking a base member by rotating said base member having said compression spring mounted thereto;

said apparatus further comprising:

b. feeding means for feeding the recording material.

38. An electrophotographic image forming apparatus for forming an image on a recording material, wherein a process cartridge is detachably mountable to said image forming apparatus, comprising:

a. mounting means for detachably mounting a process cartridge;

said process cartridge including:

an electrophotographic photosensitive drum;

a developing roller for developing a latent image formed on said electrophotographic photosensitive drum, wherein said developing roller supplies a toner to said electrophotographic photosensitive drum by rotation thereof;

a toner accommodating portion for accommodating toner to be used by said developing roller for development;

a drum frame for supporting said electrophotographic photosensitive drum and a charging member for charging said electrophotographic photosensitive drum;

a developing frame for supporting said developing roller, said developing frame to which said toner accommodating portion is mounted;

a pin for coupling said drum frame and said developing frame, wherein an engaging portion of said drum frame is engaged with an arm portion of said developing frame provided above a portion to which said developing roller is mounted, and wherein said drum frame and said developing frame are rotatable relative to each other about said pin; and a compression spring, for applying an elastic force between said drum frame and said developing frame, wherein said compression spring is mounted to said drum frame by being mounted to a locking member having said compression spring mounted thereto, by locking said locking member into said drum frame by insertion through a hole in said drum frame and locking said locking member into said drum frame by rotating said locking member to apply the elastic force to said drum frame and said developing frame thus coupled;

said apparatus further comprising:

b. feeding means for feeding the recording material.

39. An electrophotographic image forming apparatus for forming an image on a recording material, wherein a process cartridge is detachably mountable to said image forming apparatus, comprising:

a. mounting means for detachably mounting a process cartridge;

said process cartridge including:

an electrophotographic photosensitive drum;

a charging roller, contacted to said photosensitive drum, for charging said photosensitive drum; and a cleaning blade, contacted to said photosensitive drum, for removing a residual toner from said photosensitive drum;

d. developing roller for developing a latent image formed on said electrophotographic photosensitive drum, said developing roller supplies a toner to said electrophotographic photosensitive drum by rotation thereof;

e. a drum frame for supporting said electrophotographic photosensitive drum, charging roller and cleaning blade;

f. a toner accommodating portion for accommodating toner to be used by said developing roller for development;

g. a developing frame including a toner frame provided with said toner accommodating portion and a developing roller mounting frame to which said developing roller is mounted, wherein said toner frame and developing roller mounting frame are coupled and an engaging portion of said drum frame is engaged with an arm portion of said developing frame provided above a portion to which said developing roller is mounted, and wherein a pin is inserted from outside of said drum frame, through a hole provided in an arm portion of said developing frame and through a hole provided in an engaging portion of said drum frame to couple said developing frame and said drum frame and said drum frame;

h. a pin for coupling said drum frame and said developing frame, wherein an engaging portion of said drum frame is engaged with an arm portion of said developing frame provided above a portion to which said developing roller is mounted, and wherein the art portion provided at the one end on a gear cover mounted to said toner frame so as to cover a gear mounted to said toner frame, and the arm portion provided at the other end is integral with said toner frame, wherein a pin is inserted from outside of said drum frame, through a hole provided in said arm portion of said developing frame and through a hole provided in an engaging portion of said drum frame to couple said developing frame and said drum frame, wherein said pin is inserted in a longitudinal direction of said photosensitive drum wherein said drum frame and said developing frame are rotatable relative to each other about said pins; and i. a compression spring, for applying elastic force between said drum frame and said developing frame, wherein said compression spring is mounted to said drum frame by being mounted to a locking member, by locking said locking member into said drum frame by inserting through a hole in said drum frame;

said apparatus further comprising:

b. feeding means for feeding the recording material.

40. A compression spring mounting member usable with a process cartridge detachably mountable to a main assembly of an image forming apparatus, wherein said process cartridge comprises an electrophotographic photosensitive drum; developing means for developing a latent image formed on said electrophotographic photosensitive drum; a toner accommodating portion for accommodating toner to be used by said developing means for development; a drum frame for supporting said electrophotographic photosensitive drum; a developing frame for supporting said developing means, said developing frame supporting said toner accommodating portion; a coupling member for coupling said drum frame and said developing frame, wherein said drum frame and said developing frame are rotatable relative to each other about said coupling member, and wherein said compression spring for applying elastic force between said drum frame and said developing frame, said compression spring mounting member, comprising:

a base provided with a rib;

a compression spring mounting portion provided in said base; and a flange provided at a side of said base, wherein said flange is to be mounted to a frame of the process cartridge;

wherein said compression spring mounting member is mounted to the process cartridge while the compression spring is mounted to said compression spring mounting portion.

41. A member according to claim 40, wherein said base has a circular column configuration, and said rib is provided at a head portion of said circular column configuration, and wherein said base and said compression spring mounting portion are integrally formed.

42. A member according to claim 41, wherein said base of said circular column configuration has a diameter larger than a diameter of said compression spring mounted to said compression spring mounting portion.

43. A compression spring mounting member usable with a process cartridge detachably mountable to a main assembly of an image forming apparatus, wherein said process cartridge comprises an electrophotographic photosensitive drum; developing roller for developing a latent image formed on said electrophotographic photosensitive drum, said developing roller supplies a toner to said electrophotographic photosensitive drum by rotation thereof; a toner accommodating portion for accommodating toner to be used by said developing roller for development; a drum frame for supporting said electrophotographic photosensitive drum and charging member for charging said electrophotographic photosensitive drum; a developing frame for supporting said developing roller, said developing frame to which said toner accommodating portion is mounted; a pin for coupling said drum frame and said developing frame, wherein an engaging portion of said drum frame is engaged with an arm portion of said developing frame provided above a portion to which a developing roller as said developing means is mounted, and wherein said drum frame and said developing frame are rotatable relative to each other about said pin; and wherein said compression spring for applying an elastic force between said drum frame and said developing frame, wherein said compression spring being mounted to said drum frame by being mounted to a locking member, by locking said locking member into said drum frame by inserting through a hole in said drum frame, said compression spring mounting member, comprising:

a base provided with a rib;

a compression spring mounting portion provided in said base; and a flange provided at a side of said base, wherein said flange is to be mounted to a frame of the process cartridge;

wherein said compression spring mounting member is mounted to the process cartridge by being inserted, while the compression spring is mounted to said compression spring mounting portion, into a hole of a drum frame and by locking said flange to said drum frame.

44. A member according to claim 43, wherein said base of said circular column configuration has a diameter larger than a diameter of said compression spring mounted to said compression spring mounting portion.

45. A compression spring mounting member usable with a process cartridge detachably mountable to a main assembly of an image forming apparatus, wherein said process cartridge comprises an electrophotographic photosensitive drum; a charging roller, contacted to said photosensitive drum, for charging said photosensitive drum; a cleaning blade, contacted to said photosensitive drum, for removing a residual toner from said photosensitive drum; developing roller for developing a latent image formed on said electrophotographic photosensitive drum, said developing roller supplies a toner to said electrophotographic photosensitive drum by rotation thereof; a drum frame for supporting said electrophotographic photosensitive drum, charging roller and cleaning blade; a toner accommodating portion for accommodating toner to be used by said developing roller for development; a developing frame for supporting a toner frame provided with said toner accommodating portion and a developing roller mounting frame to which said developing roller is mounted, wherein said toner frame and developing roller mounting frame are coupled an engaging portion of said drum frame is engaged with an arm portion of said developing frame provided above a portion to which a developing roller is mounted, and wherein the arm portion provided at the one end on a gear cover mounted to said toner frame so as to cover a gear mounted to said toner frame, and the arm portion provided at the other end is integral with said toner frame having said toner accommodating portion, and wherein a pin is inserted from outside of said drum frame, through a hole provided in an arm portion of said developing frame and through a hole provided in an engaging portion of said drum frame to couple said developing frame and said drum frame; a pin for coupling said drum frame and said developing frame, wherein an engaging portion of said drum frame is engaged with an arm portion of said developing frame provided above a portion to which a developing roller is mounted, and wherein said drum frame and said developing frame are rotatable relative to each other about said pin, wherein a pin is inserted from outside of said drum frame, through a hole provided in an arm portion of said developing frame and through a hole provided in an engaging portion of said drum frame to couple said developing frame and said drum frame, wherein said pin is inserted in a longitudinal direction of said photosensitive drum; and wherein said compression spring for applying elastic force between said drum frame and said developing frame, wherein said compression spring being mounted to said drum frame by being mounted to a locking member, by locking said locking member into said drum frame by inserting through a hole in said drum frame to apply elastic force to said drum frame and said developing frame thus coupled;

said compression spring mounting member, comprising:

a base provided with a rib;

a compression spring mounting portion provided in said base; and a flange provided at a side of said base, wherein said flange is to be mounted to a frame of the process cartridge, wherein said compression spring mounting member is mounted to the process cartridge by being inserted, while the compression spring is mounted to said compression spring mounting portion, into a hole of a drum frame and by locking said flange to said drum frame.

* * * * *

UNITED STATES PATENT AND TRADEMARK OFFICE

CERTIFICATE OF CORRECTION

PATENT NO. : 5,749,027

DATED : May 5, 1998

INVENTOR(S) : ISAO IKEMOTO ET AL.

It is certified that error appears in the above-identified patent and that said Letters Patent is hereby corrected as shown below:

On the title page, item:

[56] REFERENCES CITED

United States Patent Documents

Insert: --5,537,187 7/1996 Sekine--.
Insert: --5,500,714 3/1996 Yashiro et al.--.
Insert: --5,289,234 2/1994 Asano et al.--.
Insert: --5,142,322 8/1992 Surti--.
Insert: --5,061,959 10/1991 Kinoshita et al.--.

COLUMN 5

Line 8, "remaining" should read --remaining on--.

COLUMN 7

Line 26, "ribs 12a1," should read --ribs 12c1,--.
Line 41, "does" should read --is--.
Line 42, "word," should read --words,--.

COLUMN 11

Line 33, "Joined" should read --joined--.

UNITED STATES PATENT AND TRADEMARK OFFICE

CERTIFICATE OF CORRECTION

PATENT NO. : 5,749,027

DATED : May 5, 1998

INVENTOR(S) : ISAO IKEMOTO ET AL.

It is certified that error appears in the above-identified patent and that said Letters Patent is hereby corrected as shown below:

COLUMN 12

Line 5, "houses a" should read --houses an--.
Line 17, "tf12a" should read --toner frame 12a--.
Line 30, "12a" should read --toner frame 12a--.
Line 37, "the" should read --The--.

COLUMN 15

Line 23, "b" should read --be--.

COLUMN 18

Line 60, "inserting through a hole in said" should be deleted.
Line 61, "drum frame by" should be deleted.
Line 63, applying" should read --apply--.

COLUMN 19

Line 47, "a" should read --and a--.
Line 64, "roller." should read --roller;--.

UNITED STATES PATENT AND TRADEMARK OFFICE

CERTIFICATE OF CORRECTION

PATENT NO. : 5,749,027

DATED : May 5, 1998

INVENTOR(S) : ISAO IKEMOTO ET AL.

It is certified that error appears in the above-identified patent and that said Letters Patent is hereby corrected as shown below:

COLUMN 20

Line 27, "toner" should read --said toner--.

COLUMN 21

Line 8, "is" should read --are--.

COLUMN 22

Line 34, "is" should read --are--.

COLUMN 23

Line 13, "frame; and" should read --frame;--.
Line 17, "is" should be deleted.
Line 30, "each" should read --each other--.
Line 40, "An apparatus" should read -- A process cartridge--.

UNITED STATES PATENT AND TRADEMARK OFFICE

CERTIFICATE OF CORRECTION

PATENT NO. : 5,749,027

DATED : May 5, 1998

INVENTOR(S) : ISAO IKEMOTO ET AL.

It is certified that error appears in the above-identified patent and that said Letters Patent is hereby corrected as shown below:

COLUMN 24

Line 6, "each" should read --each other--.
Line 7, "member;" should read --member; and--.

COLUMN 25

Line 18, "coupled and" should read --coupled, and--.
Line 26, "and said drum frame" should be deleted.

COLUMN 26

Line 2, "for applying" should read --applies--.
Line 29, "supplies" should read --supplying--.
Line 45, "for applying" should read --applies--.

UNITED STATES PATENT AND TRADEMARK OFFICE

CERTIFICATE OF CORRECTION

PATENT NO. : 5,749,027

DATED : May 5, 1998

INVENTOR(S) : ISAO IKEMOTO ET AL.

It is certified that error appears in the above-identified patent and that said Letters Patent is hereby corrected as shown below:

COLUMN 27

Line 11, "supplies" should read --supplying--.
Line 20, "coupled an" should read --coupled, an--.

Signed and Sealed this

Eighteenth Day of May, 1999

*Attest:*

*Attesting Officer*

Q. TODD DICKINSON

*Acting Commissioner of Patents and Trademarks*